US006010839A

United States Patent [19]

Crawley et al.

[11] Patent Number: 6,010,839

[45] Date of Patent: Jan. 4, 2000

[54] COLOR PHOTOGRAPHIC ELEMENTS CONTAINING YELLOW-COLORED MAGENTA DYE-FORMING MASKING COUPLERS

[75] Inventors: Michael W. Crawley, Watford, United Kingdom; Krishnan Chari, Fairport; Allan F. Sowinski, Rochester, both of N.Y.

[73] Assignee: Eastman Kodak Company, Rochester, N.Y.

[21] Appl. No.: 09/105,507

[22] Filed: Jun. 26, 1998

[51] Int. Cl.[7] ..... G03C 7/333; G03C 7/32

[52] U.S. Cl. ..... 430/558; 430/549; 430/555; 430/359; 430/562

[58] Field of Search ..... 430/359, 549, 430/555, 562, 558

[56] References Cited

U.S. PATENT DOCUMENTS

| | | |
|---|---|---|
| 1,055,155 | 3/1913 | Fischer . |
| 2,376,679 | 5/1945 | Frohlich et al. . |
| 2,428,054 | 9/1947 | Vittum et al. . |
| 2,808,329 | 10/1957 | Whitmore . |
| 2,852,370 | 9/1958 | Whitmore . |
| 3,227,550 | 1/1966 | Whitmore et al. . |
| 4,004,929 | 1/1977 | Orvis . |
| 5,241,058 | 8/1993 | Renner et al. . |
| 5,492,799 | 2/1996 | Kapp et al. . |
| 5,622,818 | 4/1997 | Kapp et al. . |

FOREIGN PATENT DOCUMENTS

| | | |
|---|---|---|
| 7-120901 | 5/1995 | Japan . |

*Primary Examiner*—Janet Baxter
*Assistant Examiner*—Amanda C. Walke
*Attorney, Agent, or Firm*—Andrew J. Anderson

[57] ABSTRACT

A multilayer silver halide color photographic element is disclosed comprising a support bearing a light-sensitive silver halide emulsion layer and a non-diffusible yellow-colored magenta dye-forming masking coupler of the following formula wherein COUP is a magenta dye-forming coupler having the azo group attached to its coupling position; ARYL represents an aromatic group, including optionally further substituted phenyl, naphthyl or heteroaryl groups; m represents an integer of from 1 to 4; each $L^1$ represents a divalent linking group, preferably —$O(CH_2)_y$—, —$NHCO(CH_2)_y$—, or —$NRCO(CH_2)_y$—, where R represents an alkyl or aryl group and y represents an integer from 1 to 4; each k is either 0 or 1; each $L^2$ represents —$NHSO_2$—, —NHCO—, —$SO_2NH$—, or —CONH—, preferably at least one $L^2$ group being —$NHSO_2$— or —$SO_2NH$—, more preferably —$NHSO_2$—; each Z represents —$SO_3M$ or —$PO_3M$, where M represents H or a counter ion such as Na, K, Li, or $NH_4$; and n represents an integer of from 1 to 5, with the provisos that when at least one $L^1$ or $L^2$ group comprises an —$NHSO_2$— or —$SO_2NH$— group then the total number of Z group substituents on the coupler is at least 2, and when no $L^1$ or $L^2$ group comprises an —$NHSO_2$— or —$SO_2NH$— group then the total number of Z group substituents on the coupler is at least 3, and if k is 0 for a substituent on the ARYL group then the $L^2$ group for that substituent is either —$NHSO_2$— or —NHCO—. Masking couplers comprising the requisite number and types of $L^1$, $L^2$ and Z groups in accordance with the invention have been found to form self-assembled micellar aggregates in water, and accordingly may be directly incorporated in aqueous solutions without the need for a dispersion making step. Further, such couplers exhibit good activity in the reaction with oxidized developer even in the absence of permanent solvent or plasticizer.

21 Claims, No Drawings

COLOR PHOTOGRAPHIC ELEMENTS CONTAINING YELLOW-COLORED MAGENTA DYE-FORMING MASKING COUPLERS

FIELD OF THE INVENTION

This invention relates to color photographic elements containing particular magenta dye-forming masking couplers.

BACKGROUND OF THE INVENTION

Most silver halide color photographic elements form multicolor images in the element by subtractive color mixing. This involves the formation of yellow, magenta and cyan dye images by color development of imagewise exposed blue, green and red sensitive silver halide emulsion layers. Ideally, the subtractive dyes so formed should absorb radiation only in the region of the spectrum which is the complement of the region of exposure. Unfortunately, all dyes have some unwanted side absorptions. To correct for these unwanted side absorptions it is common practice for color negative photographic elements to employ one or more colored masking couplers. These couplers have a color which is similar to the unwanted side absorption of one of the dyes formed from one of the image couplers. The color of the masking coupler is destroyed in the areas of the image where the dye with unwanted side absorptions is formed. The way in which colored masking couplers are employed to correct for the unwanted side absorption is described in more detail in J. Phot. Soc. Am. 13, 94(1947), J. Opt. Soc. Am. 40, 166(1950) and J. Am. Chem. Soc. 72, 1533(1950).

A preferred class of colored masking couplers are the 4-phenylazo-5-pyrazolones which correct for the unwanted yellow side absorption of magenta dye-forming couplers. Such couplers have found widespread use in color photographic elements. It is known that certain substituents on the 4-arylazo group are useful. Included, e.g., are alkoxy, hydroxy, and carbonamido groups, usually in the para position to the azo function. It has been customary to include such substituents as will permit or indeed improve the propensity of the decoupled arylazo residue to be washed out of the film during processing. The masking coupler itself, however, typically includes a hydrophobic ballast group to confer non-diffusibility to the coupler, and such masking couplers are typically dispersed in aqueous coating solutions with high boiling permanent organic solvents, known in the art as coupler solvents, using conventional homogenization dispersion techniques. Coupler solvents are generally required to provide adequate coupler activity, but excess solvent can result in increased material loads resulting in increased photographic layer thickness, which may negatively impact the optical properties of the film. High solvent levels may also raise ecological concerns.

Alternatives to dispersing hydrophobic photographic couplers with high boiling solvents have been suggested. Water soluble or dispersible "Fischer-type" incorporated couplers, e.g., may be used in photographic elements, such as those described in U.S. Pat. No. 1,055,155, issued Mar. 4, 1913, and particularly non-diffusible Fischer-type couplers containing branched hydrocarbon chains, e.g., those referred to in the references cited in Frohlich et al, U.S. Pat. No. 2,376,679, issued May 22, 1945, Column 2, lines 50–60. Fischer-type couplers form self-assembled micellar aggregates in water, and may be directly incorporated in film or photographic systems without the need for a dispersion making step. Such micelle forming couplers typically comprise strong acid moieties, however, and typically interact with gelatin in coating formulations to cause high viscosities and coating defects. Additionally, such couplers may not provide desired levels of activity in comparison to conventional solvent dispersions.

It would be desirable to provide masking couplers which may be directly incorporated into an aqueous coating solution without the need for a dispersion-making step and associated organic solvents, while still providing good activity levels. Such couplers would enable simplified photographic element manufacturing techniques and also desirably enable elements to be prepared with thinner imaging layers due to the absence of solvents otherwise needed for dispersing the couplers.

SUMMARY OF THE INVENTION

The present invention provides a multilayer silver halide color photographic element comprising a support bearing a light-sensitive silver halide emulsion layer and a non-diffusible yellow-colored magenta dye-forming masking coupler of the following formula

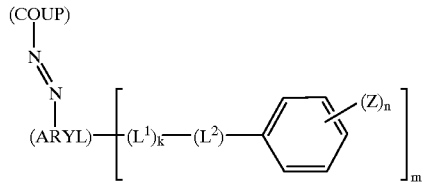

wherein

COUP is a magenta dye-forming coupler having the azo group attached to its coupling position;

ARYL represents an aromatic group, including optionally further substituted phenyl, naphthyl or heteroaryl groups;

m represents an integer of from 1 to 4;

each $L^1$ represents a divalent linking group, preferably $—O(CH_2)_y—$, $—NHCO(CH_2)_y—$, or $—NRCO(CH_2)_y—$, where R represents an alkyl or aryl group and y represents an integer from 1 to 4;

each k is either 0 or 1;

each $L^2$ represents $—NHSO_2—$, —NHCO—, $—SO_2NH—$, or —CONH—, preferably at least one $L^2$ group being $—NHSO_2—$ or $—SO_2NH—$, more preferably $—NHSO_2—$;

each Z represents $—SO_3M$ or $—PO_3M$, where M represents H or a counter ion such as Na, K, Li, or $NH_4$; and n represents an integer of from 1 to 5, with the provisos that when at least one $L^1$ or $L^2$ group comprises an $—NHSO_2—$ or $—SO_2NH—$group then the total number of Z group substituents on the coupler is at least 2, and when no $L^1$ or $L^2$ group comprises an $—NHSO_2—$ or $—SO_2NH—$ group then the total number of Z group substituents on the coupler is at least 3, and if k is 0 for a substituent on the ARYL group then the $L^2$ group for that substituent is either $—NHSO_2—$ or —NHCO—.

Masking couplers comprising the requisite number and types of $L^1$, $L^2$ and Z groups in accordance with the invention have been found to form self-assembled micellar aggregates in water, and accordingly may be directly incorporated in aqueous solutions without the need for a dispersion making step. Further, such couplers exhibit good activity in the reaction with oxidized developer even in the absence of permanent solvent or plasticizer. While micelle forming couplers comprising strong acid moieties may in some instances interact with gelatin in coating formulations to cause high viscosities and coating defects, the masking couplers of the invention are typically used at relatively low laydowns in comparison to the primary magenta image-forming couplers of the photographic material, thus minimizing any of such potential problems.

DETAILED DESCRIPTION OF THE INVENTION

In a preferred embodiment, the colored coupler is of the formula:

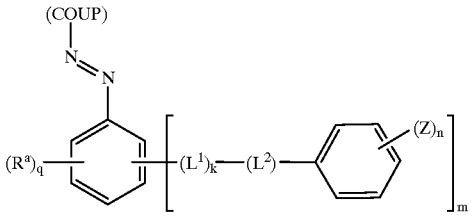

wherein:

q is an integer of from 1 to 4, and each $R^a$ independently represents a substituent group with a Hammett sigma-para value of less than 0.05, preferably less than 0.0, or two $R^a$ groups together complete a ring of from 5–7 atoms, which ring may include 1 or more heteroatoms selected from O, N and S. Each $R^a$ independently may be, e.g., an alkyl group, an aryl group, an amino group, an amido group, a ureido group, an alkoxy group, a sulfonamido group, or an aryloxy group, or two $R^a$ groups may represent an alkylene group or a dioxyalkylene group. Preferably, at least one $R^a$ group represents OR, R, $NHSO_2R$, NHCOR, or $NR_2$, where R represents an alkyl or aryl group.

Hammett sigma-para values are a measure of the electron-donating propensity of the substituent, and are described in *Substituent Constants for Correlation Analysis in Chemistry and Biology*, C. Hansch and A. J. Leo, Wiley, New York, 1979. Preferably, the substituents individually have Hammett sigma-para values in the range of −0.10 to −0.35 and together all $R^a$ groups have Hammett sigma-para values in the range of −0.10 to −0.50.

Examples of suitable $R^a$ groups are straight or branched alkyl, such as methyl, ethyl, n-propyl, i-propyl, n-butyl, s-butyl, t-butyl, t-amyl, n-docecyl, 1,1,3,3-tetramethylbutyl and 3-(2,4-di-t-amylphenoxy)propyl; straight or branched alkoxy, such as methoxy, ethoxy and t-butoxy; aryl, such as phenyl, 4-t-butylphenyl and 2,4,6-trimethylphenyl; aryloxy, such as phenoxy and 2-methylphenoxy; ureido, such as phenylureido and methylureido; amido, such as acetamido and pivalamido; amino, such as dimethylamino and morpholino; or two $R^a$ groups together are an alkylene group such as n-propylene, n-butylene, n-pentylene and n-hexylene.

COUP can be any magenta dye-forming couplers known in the art. Representative magenta dye-forming couplers comprise pyrazolone compounds of the general formulas:

(M-1)

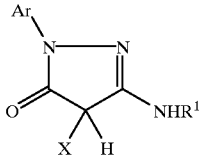

and (M-2)

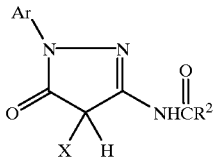

pyrazolotriazole compounds of the general formulas:

(M-3)

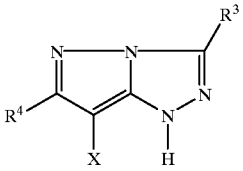

and (M-4)

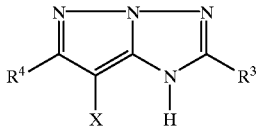

and pyrazolobenzimidazoles of the formula:

(M-5)

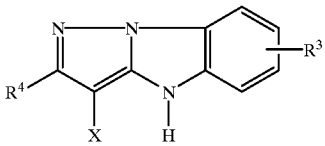

wherein

Ar is an unsubstituted aryl group or an aryl group (including pyridyl) substituted with one or more substituents selected from halogen atoms and cyano, alkylsulfonyl, arylsulfonyl, sulfamoyl, sulfonamido, carbamoyl, carbonamido, alkoxy, acyloxy, aryloxy, alkoxycarbonyl, aryloxycarbonyl, ureido, nitro, alkyl, and trifluoromethyl, or Ar is an aryl group substituted with a group which forms a link to a polymeric chain;

$R^1$ is a substituted or unsubstituted phenyl group and $R^2$ is a substituted or unsubstituted alkyl or phenyl group, the $R^1$ and $R^2$ substituents being individually selected from halogen atoms, and alkyl, aryl, alkoxy, aryloxy, carbonamido, carbamoyl, sulfonamido, sulfamoyl, alkylsulfinyl, arylsulfinyl, alkylsulfonyl, arylsulfonyl, alkoxycarbonyl, aryloxycarbonyl, acyl, acyloxy, ureido, imido, carbamate, heterocyclic, cyano, trifluoromethyl, alkylthio, nitro, carboxyl and hydroxyl groups, provided that $R^1$ and $R^2$ each contain at least 6 carbon atoms or the $R^1$ and $R^2$ substituents may individually comprise a group which forms a link to a polymeric chain;

$R^3$ and $R^4$ are individually selected from the group consisting of hydrogen, substituted and unsubstituted alkyl, substituted and unsubstituted phenyl, substituted and unsubstituted alkoxy, substituted and unsubstituted amino, substituted and unsubstituted anilino, substituted and unsubstituted acylamino, halogens and a group which links to a polymer, provided that the total number of carbon atoms contained in $R^3$ and $R^4$ is at least 6 if neither $R^3$ nor $R^4$ is a group which links to a polymer; and X represents the coupling-off position.

In preferred embodiments of the invention, COUP is a 5-pyrazolone dye-forming coupler. Particularly preferred couplers are 5-pyrazolone couplers having an anilino group in the 3-position. Such couplers may be represented by the structure:

(M-6)

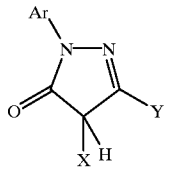

wherein:

Ar is as defined above; and

Y is an anilino group substituted with one or more substituents selected from the group consisting of halogen atoms, and alkyl, aryl, alkoxy, aryloxy, carbonamido, carbamoyl, sulfonamido, sulfamoyl, alkylsulfinyl, arylsulfinyl, alkylsulfonyl, arylsulfonyl, alkoxycarbonyl, aryloxycarbonyl, acyl, acyloxy, ureido, imido, carbamate, heterocyclic, cyano, trifluoromethyl, alkylthio, nitro, carboxyl and hydroxyl groups, and groups which form a link to a polymeric chain, and wherein Y contains at least 6 carbon atoms.

Particularly preferred are compounds in which Ar is of the structure:

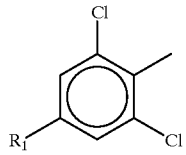

wherein $R_1$ is selected from the group consisting of halogen atoms and cyano, alkylsulfonyl, arylsulfonyl, sulfamoyl, sulfonamido, carbamoyl, carbonamido, alkoxy, acyloxy, aryloxy, alkoxycarbonyl, aryloxycarbonyl, ureido, nitro, alkyl, and trifluoromethyl groups; and Y is of the structure:

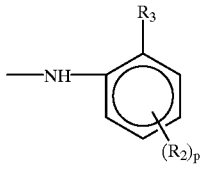

wherein p is from zero to 2 and each $R_2$ is in a meta or para position with respect to $R_3$;

each $R_2$ is individually selected from the group consisting of halogen, alkyl, aryl, alkoxy, aryloxy, carbonamido, carbamoyl, sulfonamido, sulfamoyl, alkylsulfinyl, arylsulfinyl, alkylsulfonyl, arylsulfonyl, alkoxycarbonyl, aryloxycarbonyl, acyl, acyloxy, ureido, imido, carbamate, heterocyclic, cyano, trifluoromethyl, alkylthio, nitro, carboxyl and hydroxyl groups; and $R_3$ is selected from the group consisting of hydrogen, halogen, alkyl, aryl, alkoxy, aryloxy, alkylthio, carbonamido, carbamoyl, sulfonamido, sulfamoyl, alkylsulfonyl, arylsulfonyl, alkoxycarbonyl, acyloxy, acyl, cyano, nitro and trifluoromethyl groups.

The masking couplers of this invention are rendered non-diffusible as coated in the photographic element by the presence on the coupler of a ballast group. A ballast group is a group of such size and configuration that, in combination with the remainder of the molecule, it provides the coupler with sufficient bulk to be substantially non-diffusible from the layer in which it is coated in the element. The ballast group is preferably part of COUP, as is the case with dye-image forming couplers. Alternatively, the ballast group can be on the phenylazo group, in which case the dye formed on coupling may be diffusible. Representative ballast groups include alkyl or aryl groups containing 6 to 32 carbon atoms. Other ballast groups include alkoxy, aryloxy, arylthio, alkylthio, alkoxycarbonyl, aryloxycarbonyl, carboxy, acyl, acyloxy, carbonamido, carbamoyl, alkylcarbonyl, arylcarbonyl, alkysulfonyl, arylsulfonyl, sulfamoyl, sulfenamoyl, sulfonamido, alkylsulfinyl, arylsulfinyl, alkylphosphonyl, alkoxyphosphonyl, and arylphosphonyl of 6 to 32 carbon atoms.

As used herein, unless otherwise indicated the alkyl and aryl groups, and the alkyl and aryl portions of other substituent groups, can be unsubstituted or substituted with non-interfering substituents. Typical alkyl groups have 1 to 32 carbon atoms and typical aryl groups have 6 to 32 carbon atoms. Depending upon the position of the group, preferred alkyl groups can have 1 to 20 carbon atoms, 1 to 12 carbon atoms or 1 to 4 carbon atoms and preferred aryl groups can have 6 to 20 or 6 to 10 carbon atoms. Other groups which contain a replaceable hydrogen atom can be substituted or not, depending on the particular structure and properties desired.

Throughout this application a reference to any type of chemical "group" includes both the unsubstituted and substituted forms of the group described. Generally, unless otherwise specifically stated, substituent groups usable on couplers herein include any groups, whether substituted or unsubstituted, which do not destroy properties necessary for their use as masking couplers. Examples of substituents on any of the mentioned groups can include known substituents, such as: halogen, for example, chloro, fluoro, bromo, iodo; alkoxy, particularly those with 1 to 6 carbon atoms (for example, methoxy, ethoxy); substituted or unsubstituted alkyl, particularly lower alkyl (for example, methyl, trifluoromethyl); alkenyl or thioalkyl (for example, methylthio or ethylthio), particularly either of those with 1 to 6 carbon atoms; substituted and unsubstituted aryl, particularly those having from 6 to 20 carbon atoms (for example, phenyl); and substituted or unsubstituted heteroaryl, particularly those having a 5 or 6-membered ring containing 1 to 3 heteroatoms selected from N, O, or S (for example, pyridyl, thienyl, furyl, pyrrolyl); and others known in the art. Alkyl substituents may specifically include "lower alkyl", that is having from 1 to 6 carbon atoms, for example, methyl, ethyl, and the like. Further, with regard to any alkyl group, alkylene group or alkenyl group, it will be understood that these can be branched or unbranched and include ring structures.

Table I, below, depicts as COUP-1 through COUP-20 examples of preferred pyrazolone coupler parents to whose coupling position (represented by a single bond in the 4-position of the pyrazolone ring) an arylazo group can be joined. COUP-21 through COUP-23 represent additional magenta dye forming coupler parents which may be used in accordance with the invention, wherein the coupling position is indicated by X.

Table II, below, depicts as AZ-1 through AZ-16 arylazo groups which may be used in accordance with the invention.

Table III, below, depicts as I-1 through I-11 representative colored masking couplers in accordance with the invention.

TABLE I

COUP-1

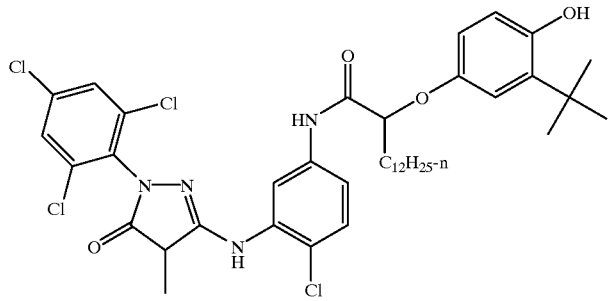

COUP-2

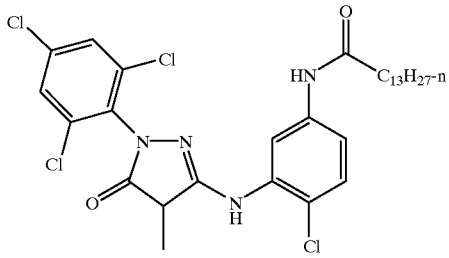

COUP-3

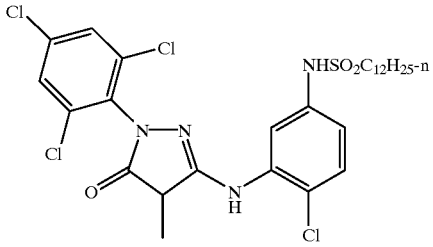

COUP-4

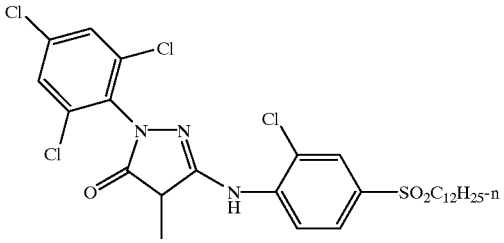

COUP-5

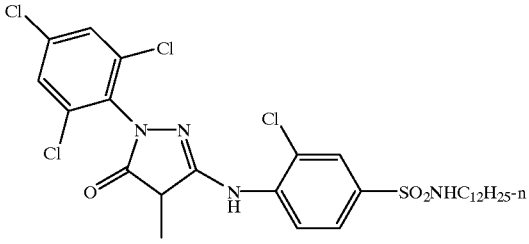

TABLE I-continued
COUP-6
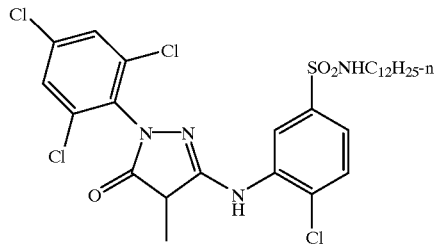
COUP-7
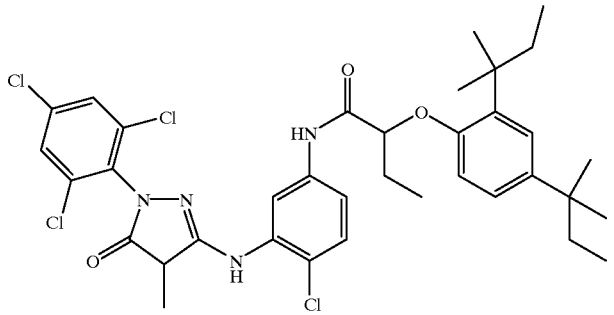
COUP-8
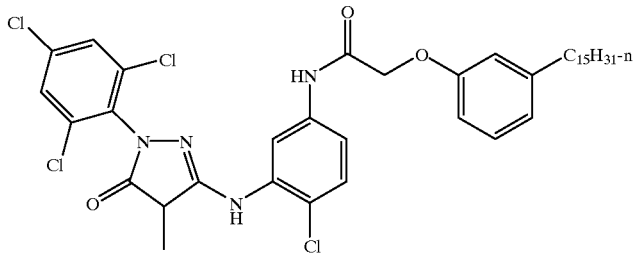
COUP-9
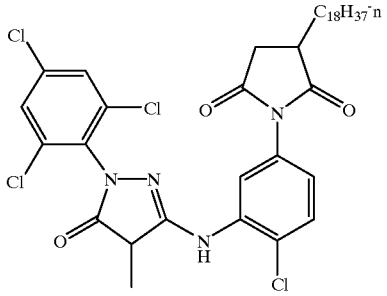
COUP-10
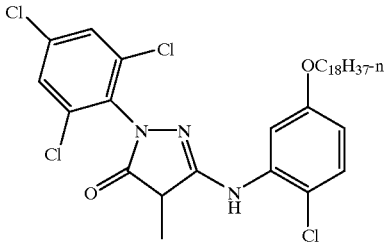

TABLE I-continued
COUP-11
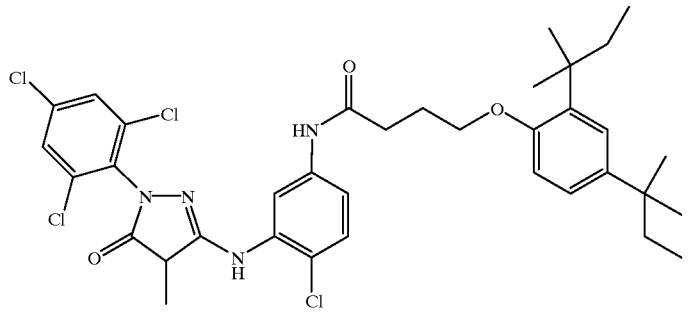
COUP-12
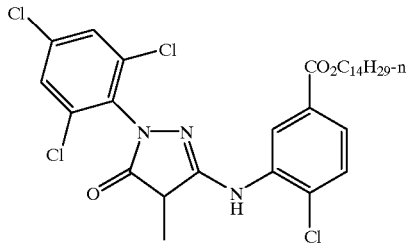
COUP-13
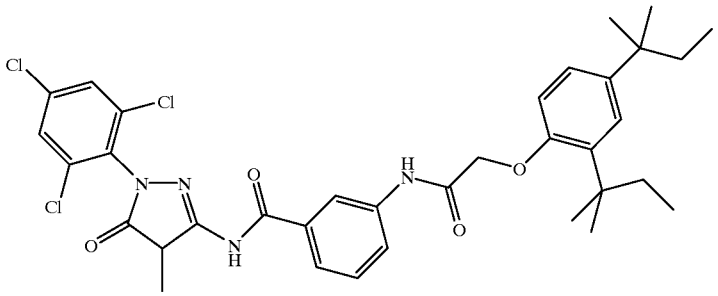
COUP-14
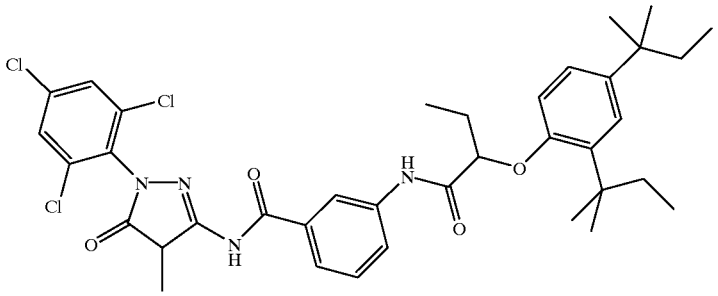
COUP-15
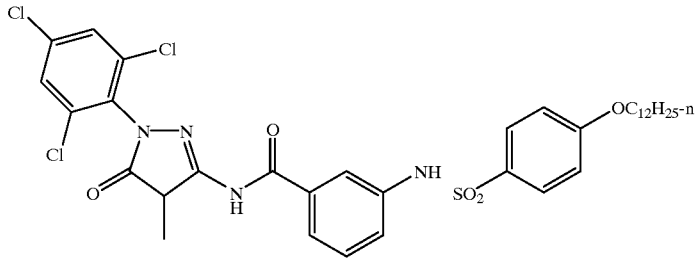

TABLE I-continued
COUP-16
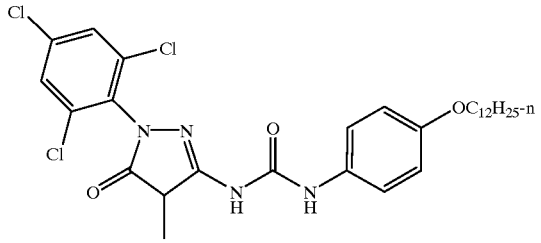
COUP-17
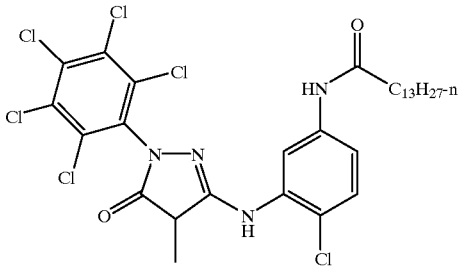
COUP-18
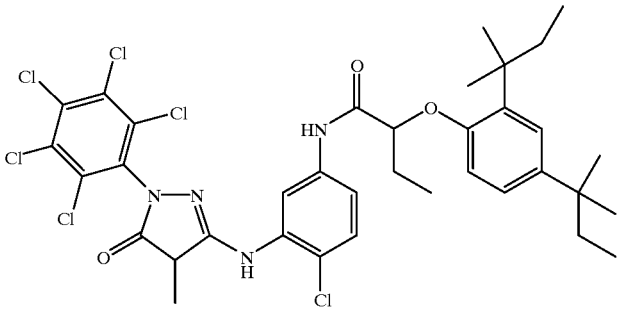
COUP-19
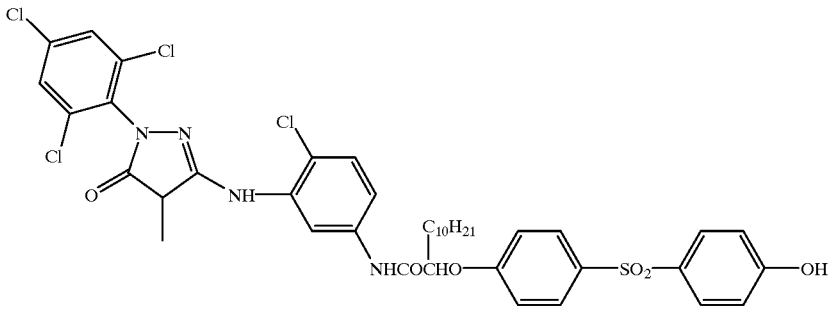
COUP-20
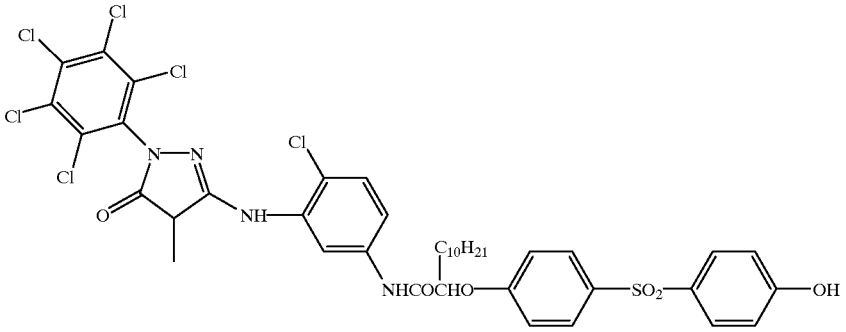

TABLE I-continued
COUP-21
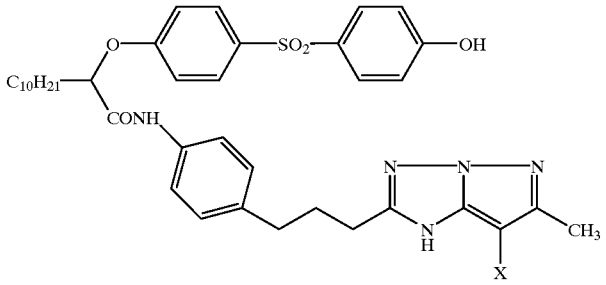
COUP-22
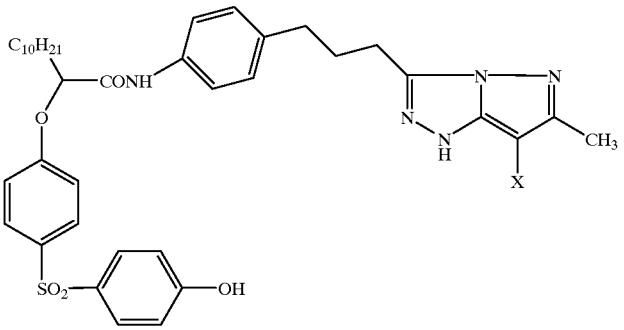
COUP-23
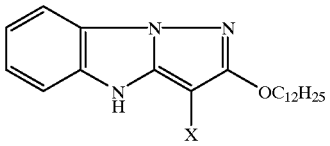
TABLE II
AZ-1
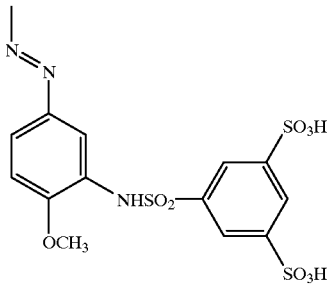
AZ-2
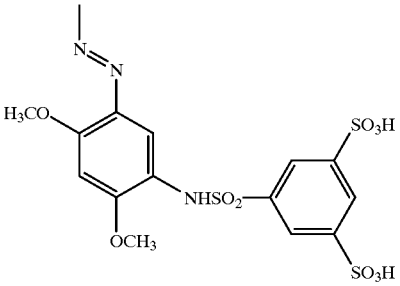
TABLE II-continued
AZ-3
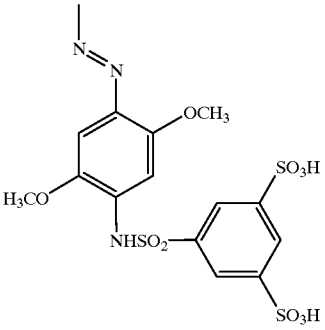
AZ-4
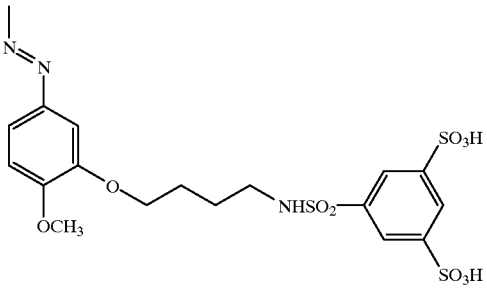

TABLE II-continued
AZ-5
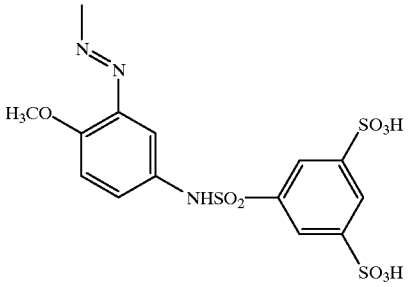
AZ-6
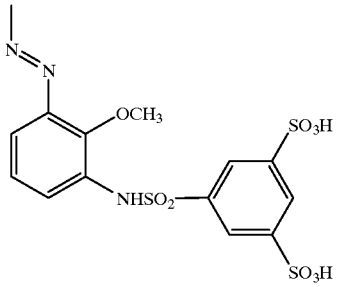
AZ-7
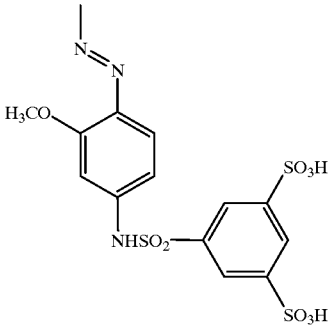
AZ-8
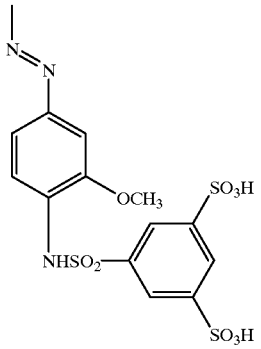
TABLE II-continued
AZ-9
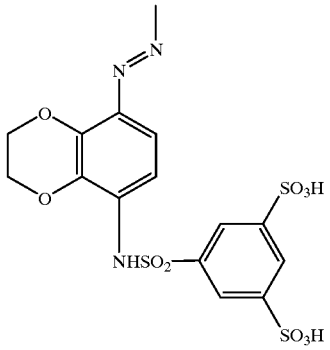
AZ-10
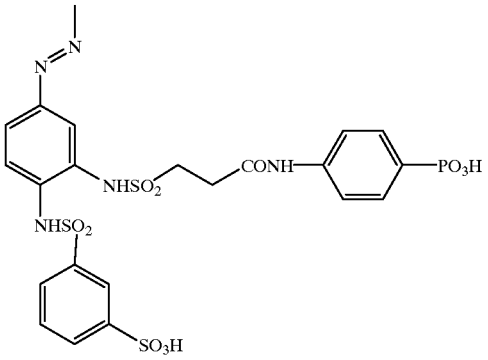
AZ-11
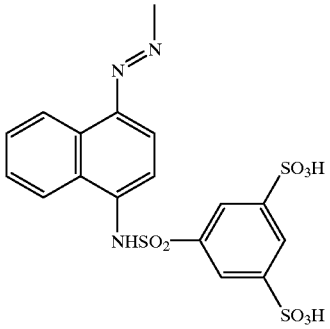
AZ-12
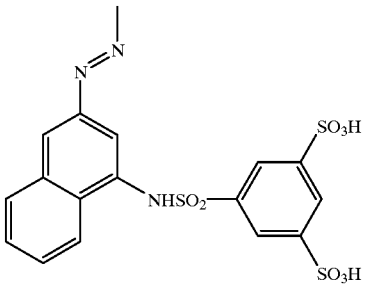

TABLE II-continued
AZ-13
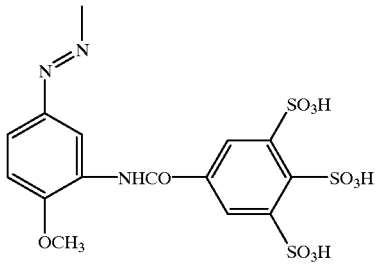
AZ-14
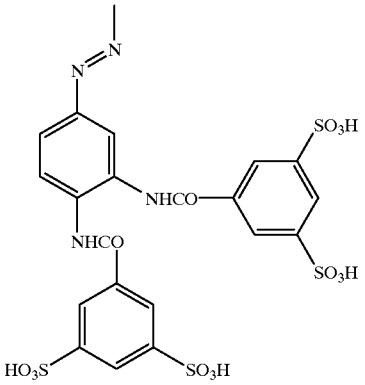
TABLE II-continued
AZ-15
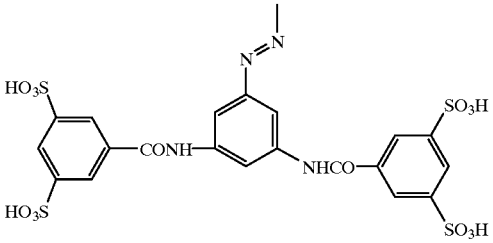
AZ-16
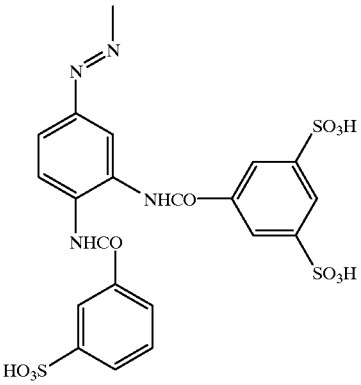
TABLE III
I-1
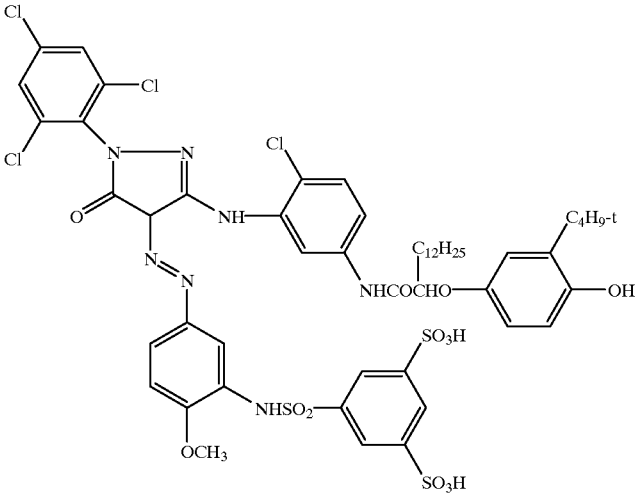

TABLE III-continued
I-2
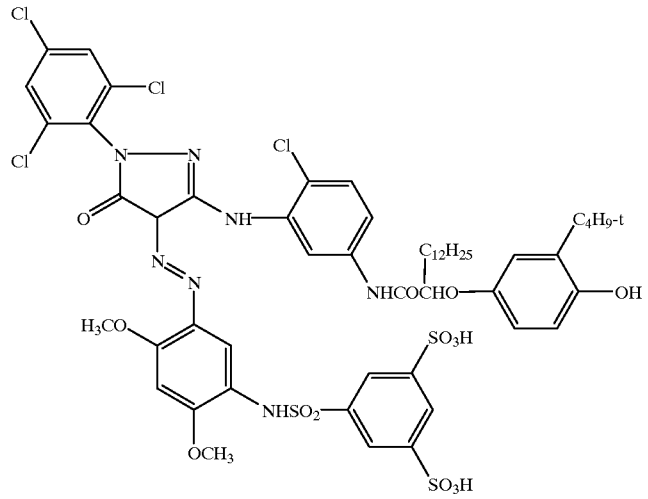
I-3
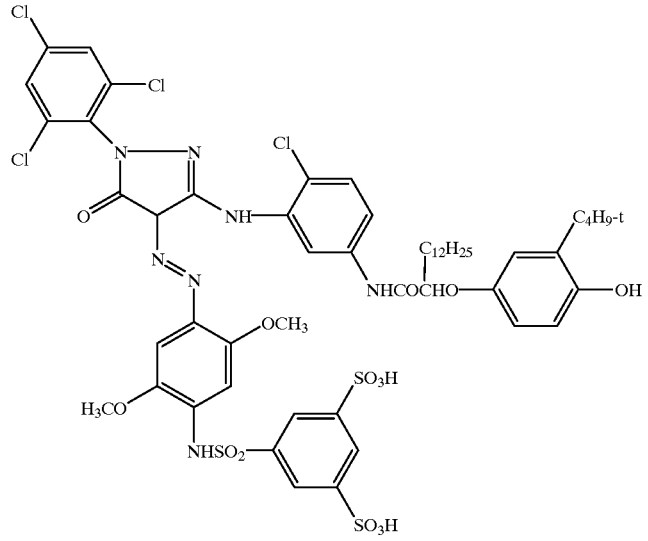
I-4
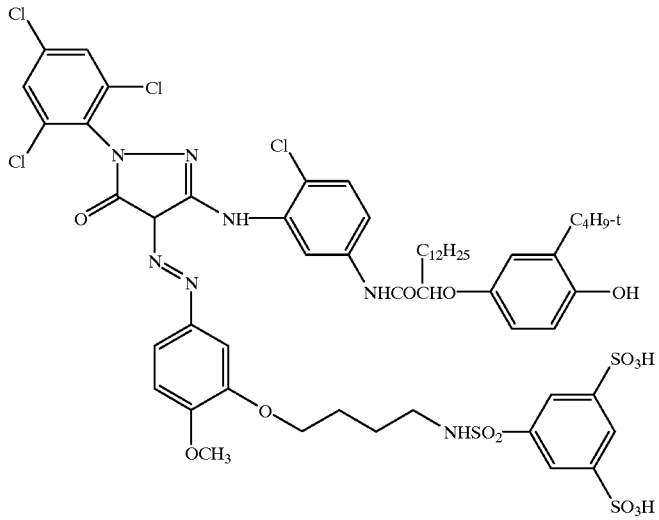

TABLE III-continued
I-5
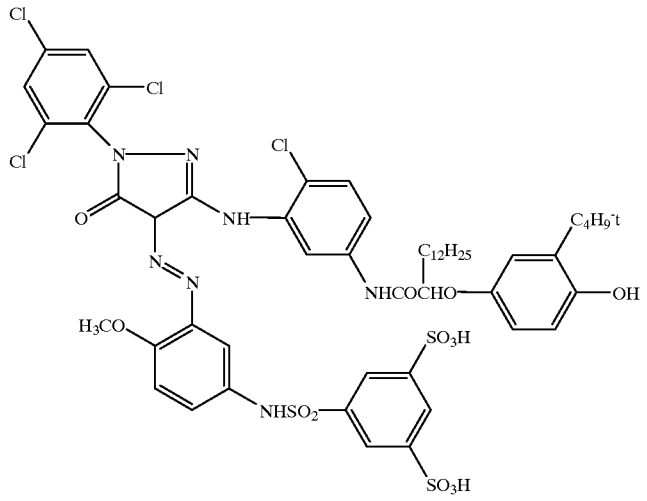
I-6
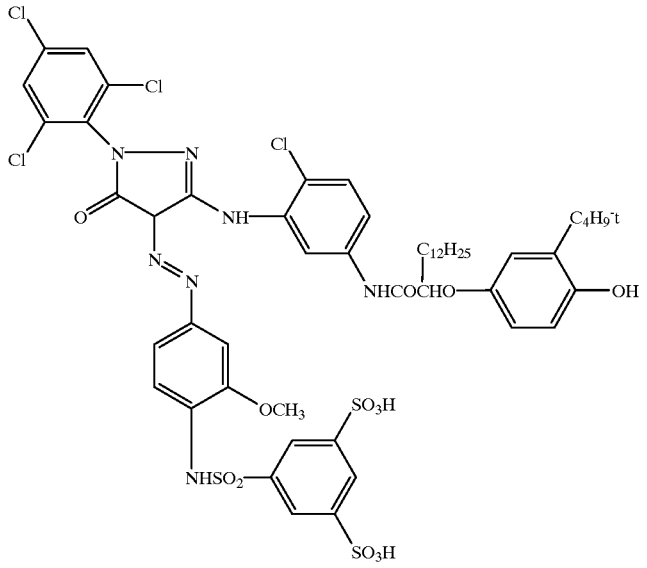
I-7
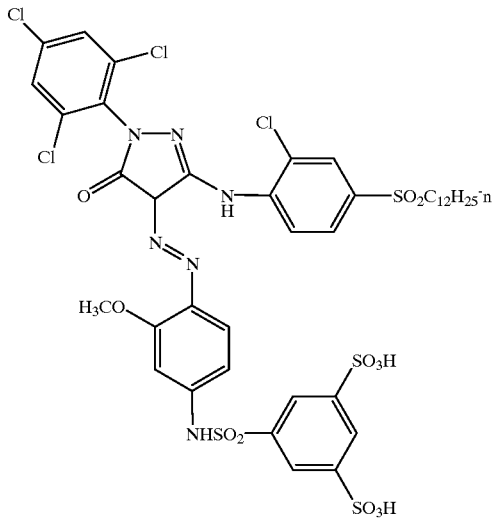

TABLE III-continued
I-8
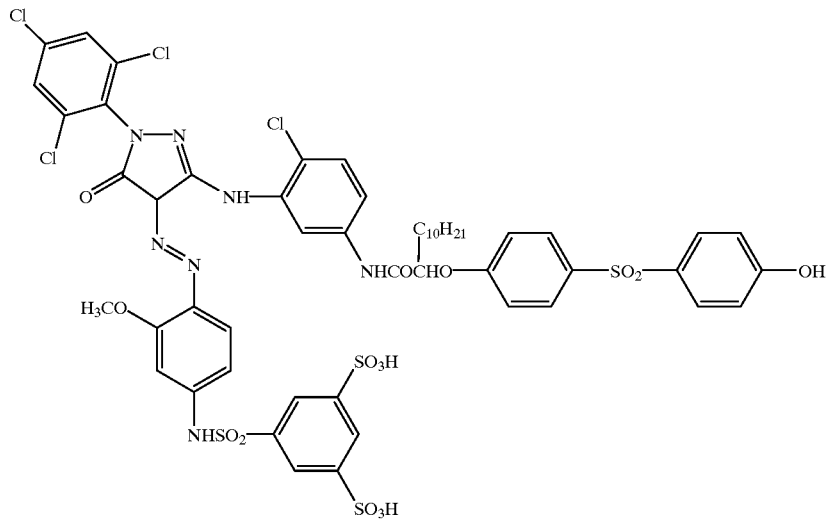
I-9
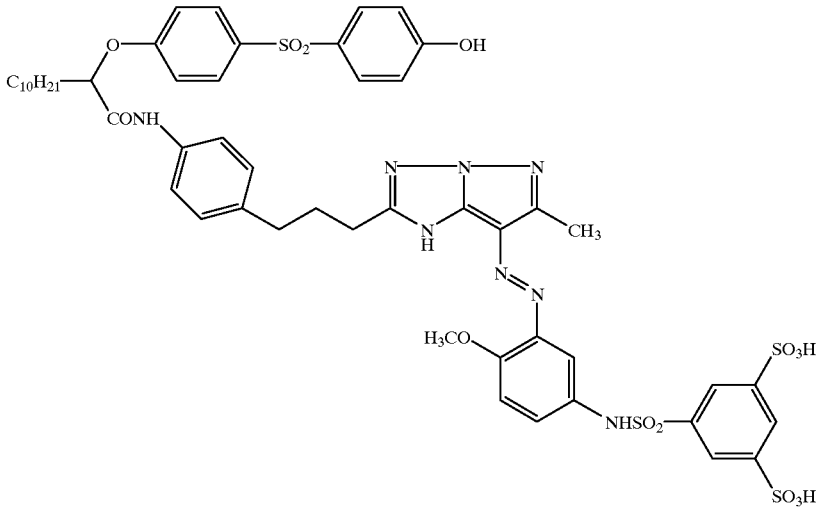
I-10
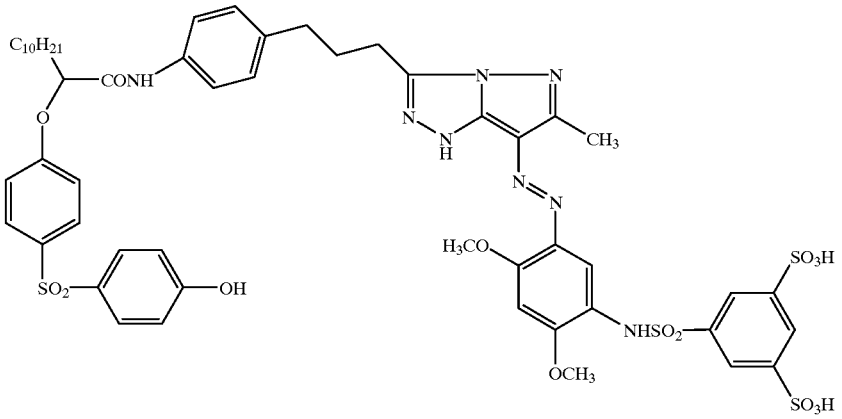

TABLE III-continued

I-11

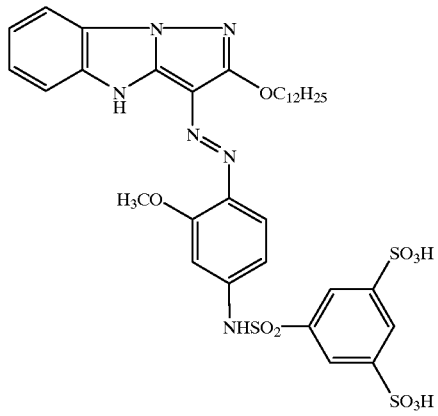

The masking couplers of this invention can be prepared by synthetic techniques well known to those skilled in the chemical art. An illustrative synthesis is shown in the Examples below.

The masking couplers of the invention are typically coated in the element at coverages of less than 0.4 mmol/$m^2$, preferably at a coverage of from 0.1 mmol/$m^2$ to 0.3 mmol/$m^2$, and more preferably at a coverage of from 0.18 to 0.24 mmol/$m^2$. Primary magenta dye image-forming couplers, in contrast, are typically present in photographic elements at coverages of 0.4 mmol/$m^2$ and above, most typically at a coverage of from 0.4 mmol/$m^2$ to 0.9 mmol/$m^2$.

The color photographic element of this invention comprises, in addition to the magenta coupler-containing layer, various other layers typically included in color photographic elements. Multicolor color photographic elements typically contain image dye-forming units sensitive to each of the three primary regions of the visible spectrum. Each unit can comprise a single emulsion layer or multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer.

A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers, such as filter layers, interlayers, overcoat layers, subbing layers, and the like.

The masking couplers of the invention may be used in a photographic element in combination with any conventional primary magenta dye-forming couplers, such as those of the above formulas M-1 through M-6, wherein X represents H or a coupling-off group. Coupling-off groups are well known to those skilled in the photographic art. Generally, such groups determine the equivalency of the coupler and modify the reactivity of the coupler. Coupling-off groups can also advantageously affect the layer in which the coupler is coated or other layers in the photographic material by performing, after release from the coupler, such functions as development inhibition, bleach acceleration, color correction, development acceleration and the like. Representative coupling-off groups include halogens (for example, chloro), alkoxy, aryloxy, alkylthio, arylthio, acyloxy, sulfonamido, carbonamido, arylazo, nitrogen-containing heterocyclic groups such as pyrazolyl and imidazolyl, and imido groups such as succinimido and hydantoinyl groups. Except for the halogens, these groups may be substituted if desired. Coupling-off groups are described in further detail in: U.S. Pat. Nos. 2,355,169; 3,227,551; 3,432,521; 3,476,563; 3,617,291; 3,880,661; 4,052,212 and 4,134,766, and in British Patent References Nos. 1,466,728; 1,531,927; 1,533,039; 2,006,755A and 2,017,704A, the disclosures of which are incorporated herein by reference.

Photographic elements of this invention can have the structures and components shown on Research Disclosure, February 1995, Item 37038, pages 79–114. Research Disclosure is published by Kenneth Mason Publications, Ltd., Dudley Annex, 12a North Street, Emsworth, Hampshire P010 7DQ, ENGLAND. Photographic elements of the present invention can be imagewise exposed and processed using known techniques and compositions, including those described in the Research Disclosure Item 37038 cited above.

If desired, the photographic element can be used in conjunction with an applied magnetic layer as described in *Research Disclosure*, November 1992, Item 34390.

A typical color negative film construction useful in the practice of the invention is illustrated by the following:

| Element SCN-1 | |
|---|---|
| SOC | Surface Overcoat |
| BU | Blue Recording Layer Unit |
| IL1 | First Interlayer |
| GU | Green Recording Layer Unit |
| IL2 | Second Interlayer |
| RU | Red Recording Layer Unit |
| S | Support |
| AHU | Antihalation Layer Unit |
| SOC | Surface Overcoat |

The support S can be either reflective or transparent, the latter being usually preferred. When reflective, the support is white and can take the form of any conventional support currently employed in color print elements. When the support is transparent, it can be colorless or tinted and can take the form of any conventional support currently employed in color negative elements—e.g., a colorless or tinted transparent film support. Details of support construction are well understood in the art. Transparent and reflective support constructions, including subbing layers to enhance adhesion, are disclosed in *Research Disclosure*, Item 38957, cited above, XV. Supports.

Each of blue, green and red recording layer units BU, GU and RU are formed of one or more hydrophilic colloid layers and contain at least one radiation-sensitive silver halide emulsion and coupler, including at least one dye image-forming coupler. In the simplest contemplated construction each of the layer units consists of a single hydrophilic colloid layer containing emulsion and coupler. When coupler present in a layer unit is coated in a hydrophilic colloid layer other than an emulsion containing layer, the coupler containing hydrophilic colloid layer is positioned to receive oxidized color developing agent from the emulsion during development. Usually the coupler containing layer is the next adjacent hydrophilic colloid layer to the emulsion containing layer.

The emulsion in BU is capable of forming a latent image when exposed to blue light. When the emulsion contains high bromide silver halide grains and particularly when minor (0.5 to 20, preferably 1 to 10, mol percent, based on silver) amounts of iodide are also present in the radiation-sensitive grains, the native sensitivity of the grains can be relied upon for absorption of blue light. Preferably, however, the emulsion is spectrally sensitized with one or more blue spectral sensitizing dyes. The emulsions in GU and RU are spectrally sensitized with green and red spectral sensitizing dyes, respectively, in all instances, since silver halide emulsions have no native sensitivity to green and/or red (minus blue) light.

Any convenient selection from among conventional radiation-sensitive silver halide emulsions can be incorporated within the layer units. Most commonly high bromide emulsions containing a minor amount of iodide are employed. To realize higher rates of processing high chloride emulsions can be employed. Radiation-sensitive silver chloride, silver bromide, silver iodobromide, silver iodochloride, silver chlorobromide, silver bromochloride, silver iodochlorobromide and silver iodobromochloride grains are all contemplated. The grains can be either regular or irregular (e.g., tabular). Tabular grain emulsions, those in which tabular grains account for at least 50 (preferably at least 70 and optimally at least 90) percent of total grain projected area are particularly advantageous for increasing speed in relation to granularity. To be considered tabular a grain requires two major parallel faces with a ratio of its equivalent circular diameter (ECD) to its thickness of at least 2. Specifically preferred tabular grain emulsions are those having a tabular grain average aspect ratio of at least 5 and, optimally, greater than 8. Preferred mean tabular grain thicknesses are less than 0.3 $\mu$m (most preferably less than 0.2 $\mu$m). Ultrathin tabular grain emulsions, those with mean tabular grain thicknesses of less than 0.07 $\mu$m, are specifically preferred. The grains preferably form surface latent images so that they produce negative images when processed in a surface developer.

Illustrations of conventional radiation-sensitive silver halide emulsions are provided by *Research Disclosure*, Item 38957, cited above, I. Emulsion grains and their preparation. Chemical sensitization of the emulsions, which can take any conventional form, is illustrated in section IV. Chemical sensitization. Spectral sensitization and sensitizing dyes, which can take any conventional form, are illustrated by section V. Spectral sensitization and desensitization. The emulsion layers also typically include one or more antifoggants or stabilizers, which can take any conventional form, as illustrated by section VII. Antifoggants and stabilizers.

BU contains at least one yellow dye image-forming coupler, GU contains at least one magenta dye image-forming coupler, and RU contains at least one cyan dye image-forming coupler. Any convenient combination of conventional dye image-forming couplers can be employed. Conventional dye image-forming couplers are illustrated by *Research Disclosure*, Item 38957, cited above, X. Dye image formers and modifiers, B. Image-dye-forming couplers.

As in conventional color negative film constructions, RU, GU and BU can contain other colored masking couplers in addition to those in accordance with the invention.

Development inhibitor releasing compound is typically incorporated in at least one and, preferably, each of the layer units. DIRs are commonly employed to improve image sharpness and to tailor dye image characteristic curve shapes. The DIRs contemplated for incorporation in the color negative elements of the invention can release development inhibitor moieties directly or through intermediate linking or timing groups. The DIRs are contemplated to include those that employ anchimeric releasing mechanisms. Illustrations of development inhibitor releasing couplers and other compounds useful in the color negative elements of this invention are provided by *Research Disclosure*, Item 38957, cited above, X. Dye image formers and modifiers, C. Image dye modifiers, particularly paragraphs (4) to (11).

The following examples further illustrate this invention.

SYNTHESIS EXAMPLE

Coupler I-1 was prepared according to the following synthetic scheme:

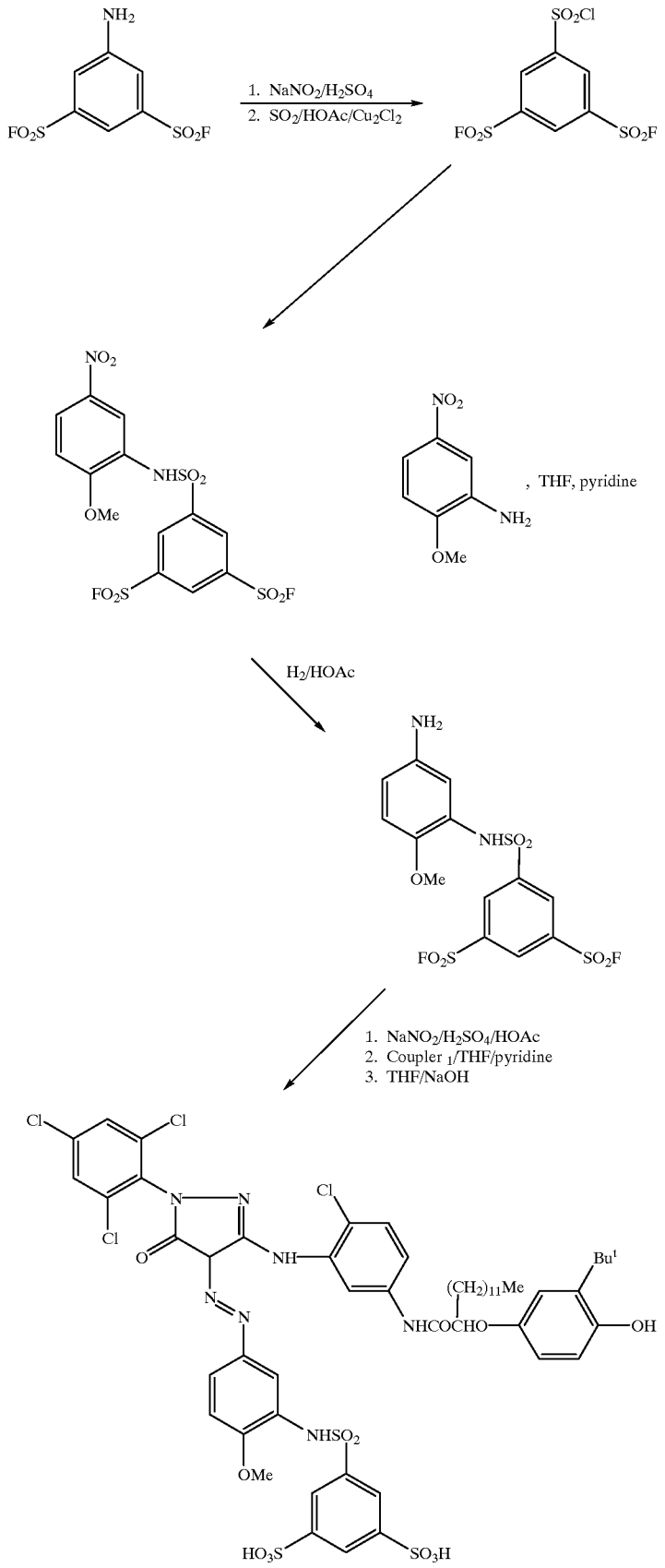
NH2
FO2S
SO2F
1. NaNO2/H2SO4
2. SO2/HOAc/Cu2Cl2
SO2Cl
NO2
NHSO2
OMe
, THF, pyridine
H2/HOAc
1. NaNO2/H2SO4/HOAc
2. Coupler 1/THF/pyridine
3. THF/NaOH
Cl
N
O
NH
(CH2)11Me
Bu^t
NHCOCHO
OH
HO3S
SO3H 1. 3,5-Bis-(fluorosulphonyl)benzenesulphonyl chloride

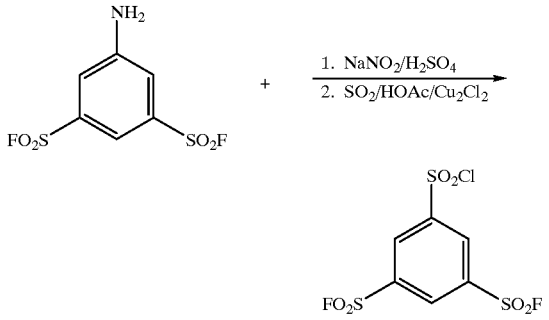

Sodium nitrite (20 g, 290 mmol) was added portionwise with vigorous stirring to cold concentrated sulphuric acid (150 ml) and stirred until dissolved. 3,5-bis-(fluorosulphonyl)aniline (51.4 g, 200 mmol) was added portionwise and stirred until dissolved. The acidic solution was added dropwise to a stirred mixture of 1:4 propionic acid: acetic acid (400 ml) at <10° C. and stirred for 1 hour to complete diazotization. Excess nitrous acid was destroyed with sulphamic acid. Meanwhile a stirred mixture of 1:4 mixed acid (1 liter) was cooled to <10° C., cuprous chloride (10 g) added, and sulphur dioxide gas passed through the pale blue solution for 1.5 hours. The diazonium solution was added portionwise to this solution, allowing the frothing to subside between additions, and stirred for 1 hour. The solution initially became lilac in color and then deep mauve to gray-mauve on continued addition of the diazonium solution. Water (1.6 liter) and hydrochloric acid (400 ml) was added cautiously in portions allowing for the frothing to subside. A cream solid in a bright pea-green solution was obtained. The suspension was stirred for 15 minutes and the solid filtered off, washed with water and dried in air. The yield of 3,5-bis-(fluorosulphonyl)benzenesulphonyl chloride was 48.3 g, 71%.

2. N-(2-methoxy-5-nitrophenyl)-3,5-bis-(fluorosulphonyl) benzenesulphonamide

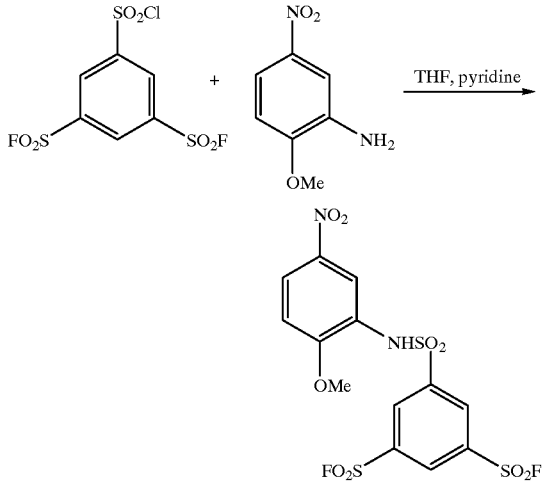

2-Methoxy-5-nitroaniline (16.8 g, 100 mmol) was dissolved in dry, stirred tetrahydrofuran (100 ml) and pyridine (8.0 g, 101 mmol) added followed by 3,5-bis-(fluorosulphonyl)benzene sulphonyl chloride (34.0 g, 100 mmol) dissolved in dry tetrahydrofuran (100 ml). The mixture was stirred for 20 hours. Thin layer chromatography (1:2 ethyl acetate: petroleum ether) indicated one major product and one minor product present. The mixture was poured into stirred 10% hydrochloric acid and the solid filtered off, washed, dried and chromatographed with 1:2 ethyl acetate:petroleum ether. The yield of pure N-(2-methoxy-5-nitrophenyl)-3,5-bis-(fluorosulphonyl) benzenesulphonamide was 17.4 g, 37%. The minor component was identified as the N,N-disubstituted aniline, N,N-bis-[3,5-bis(fluorosulphonyl)benzenesulphonyl)]-2-methoxy-5-nitroaniline, 6.4 g, 16%.

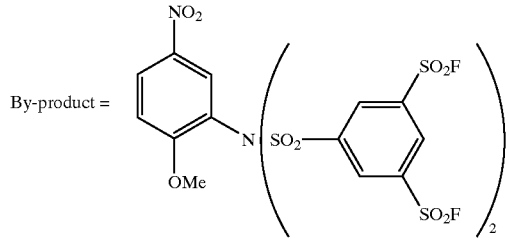

3. N-(5-Amino-2-methoxyphenyl)-3,5-bis-(fluorosulphonyl)benzenesulphonamide

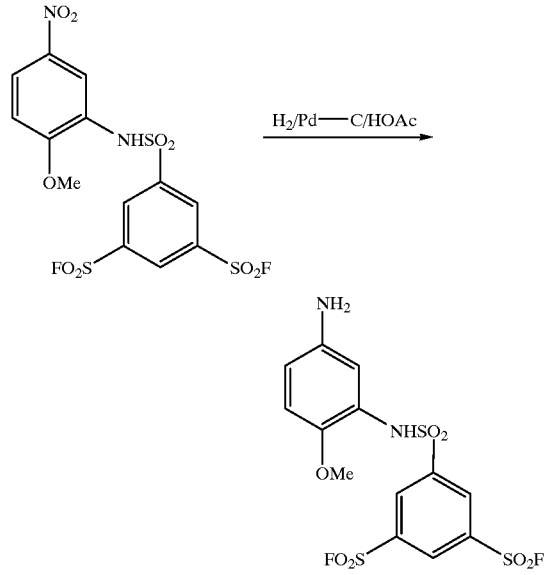

N-(2-Methoxy-5-nitrophenyl)-3,5-bis-(fluorosulphonyl) benzenesulphonamide (15.3 g, 32.4 mmol) was suspended in acetic acid (250 ml) and 10% palladium on charcoal (2 g) added. The mixture was hydrogenated at room temperature under 35 atmospheres of hydrogen for 1.5 hours, and the catalyst removed by filtration through Kieselguhr. TLC (1:1 ethyl acetate: petroleum ether) showed one new spot which coupled with amine spray reagent. The amine was used as such in the next stage. It is advisable to use the amine straight away as it is sensitive to aerial oxidation.

4. Diazotization and coupling of N-(5-amino-2-methoxyphenyl)-3,5-bis-(fluorosulphonyl)-benzenesulphonamide Synthesis of:

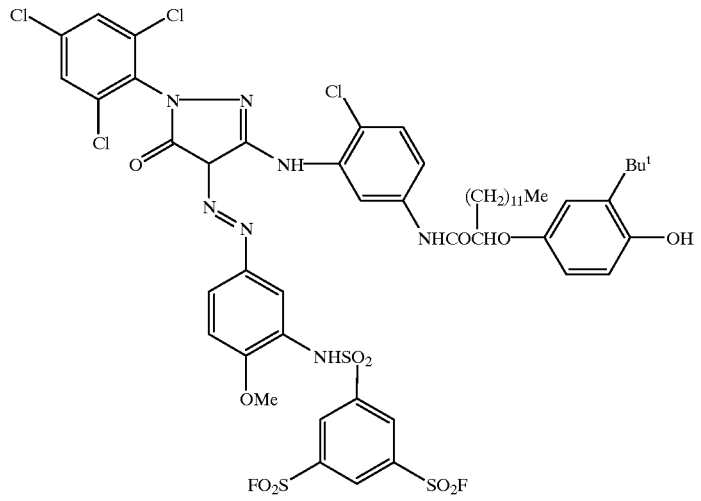

The solution containing the above amine was rapidly reduced to ca. 50 ml by rotary evaporation and cooled to 10° C. A solution of sodium nitrite (2.42 g, 35 mmol) in cold concentrated sulphuric acid (10 ml) was prepared and added dropwise to the amine solution and stirred for 30 minutes at <10° C. Excess nitrous acid was destroyed with sulphamic acid. Meanwhile a solution of the four equivalent coupler N-[4-chloro-3-[[4,5-dihydro-5-oxo-1-(2,4,6-trichlorophenyl)-1H-pyrazol-3-yl]amino]phenyl]-2-[3-(1,1-dimethylethyl)-4-hydroxyphenoxy]-tetradecanamide (27.2 g, 35 mmol) in tetrahydrofuran (200 ml) and pyridine (160 ml) was prepared and cooled to <10° C. The diazonium solution was added dropwise to the coupler solution over 10 minutes and then stirred for a further 30 minutes. A deep red solution was obtained. The mixture was poured into a stirred 10% solution of hydrochloric acid in water (4 liters) and the solid filtered off and dried. The yield of crude product was 43.3 g (>100%). TLC analysis (1:2 ethyl acetate: petrol) showed mainly the product, some starting material (coupler), a trace of the coupler oxime and a little hydrolyzed product. The crude material was used as such in the next stage.

5. Coupler I-1 N-[4-chloro-3-[[4,5-dihydro-5-oxo-1-(2,4,6-trichlorophenyl)-4-[4-methoxy-3-(3,5-bis-sulphophenylsulphamoyl)phenylazo]-1H-pyrazol-3-yl]amino]phenyl]-2-[3-(1,1-dimethylethyl)-4-hydroxyphenoxy]-tetradecanamide Synthesis of:

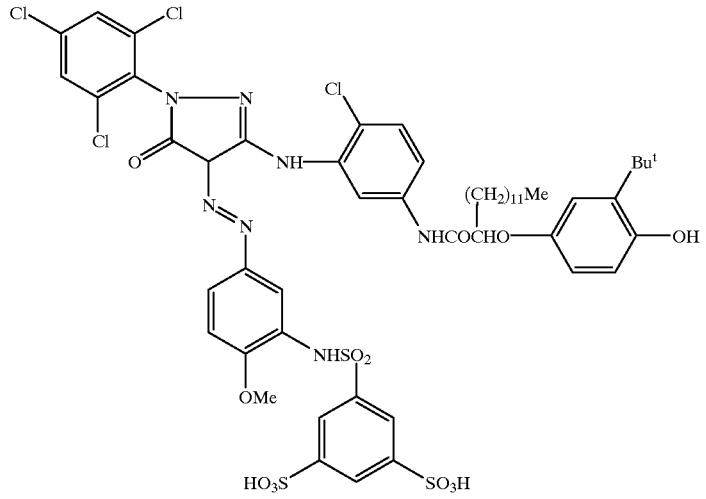

The crude azo dye from step 4. (42.3 g, approx. 34.4 mmol) was dissolved in tetrahydrofuran (250 ml) and a solution of sodium hydroxide (6.9 g, 172 mmol) in water (20 ml) added with stirring. The mixture was stirred for 1 hour, after which time TLC indicated the absence of starting material and product as an orange baseline spot. The mixture was poured into stirred 10% hydrochloric acid in water (3 liters) and the oily material extracted into ethyl acetate. The dried extract was evaporated to dryness and the residue taken up in ethyl acetate (ca. 500 ml) and applied to a dry silica gel plug. The plug was flushed with ethyl acetate to afford a dark brown eluent which consisted of nonsulphonated impurities such as residual coupler, coupler oxime and oxidation products of the amine. Once the eluent became clear and no further impurities were detected by TLC the plug was flushed with tetrahydrofuran. Some yellow material was removed during this process (including some product—this was recycled). Dimethyl formamide was used to remove the product from the silica plug and flushing was continued until the eluent was only faintly yellow. Removal of the solvent gave the product as a crunchy red solid, 31.9 g, 76%.

PHOTOGRAPHIC EXAMPLE 1

This example illustrates the photographic activity of solvent-free masking coupler dispersions in accordance with the invention.

Dispersion Preparation

Aqueous dispersions of couplers I-1, I-2 and I-3 of the invention and comparison couplers C-1 through C-5 were prepared as indicated below:

C-1

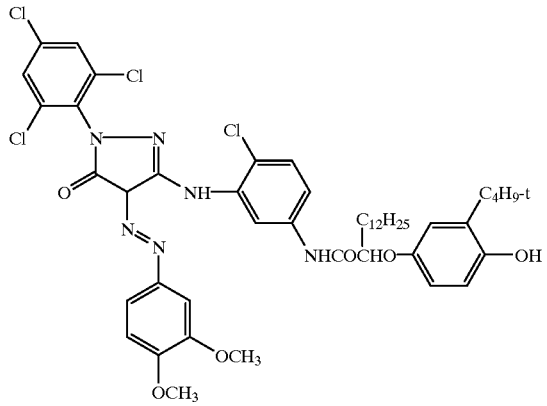

C-2

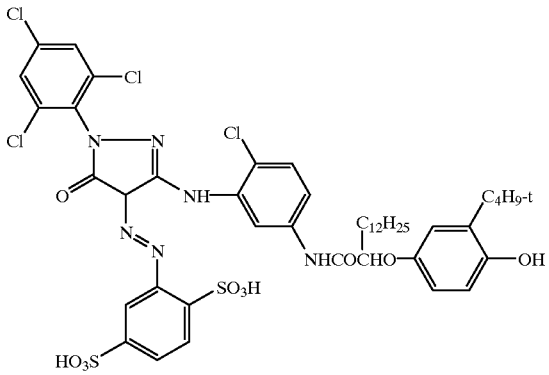

-continued

C-3

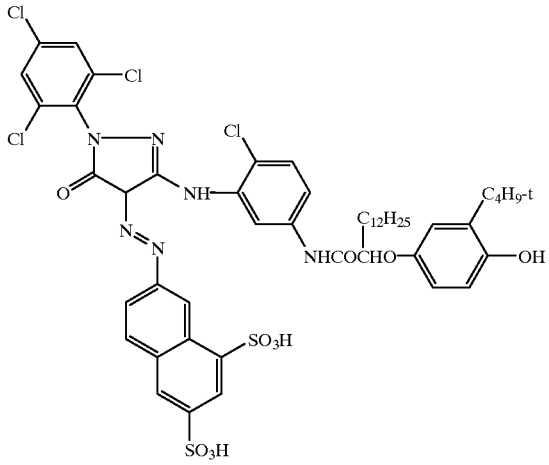

C-4

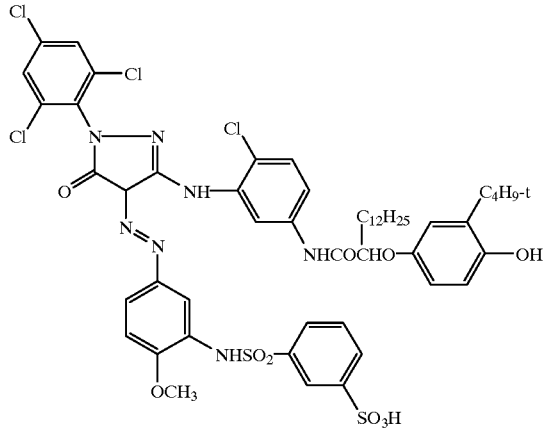

C-5

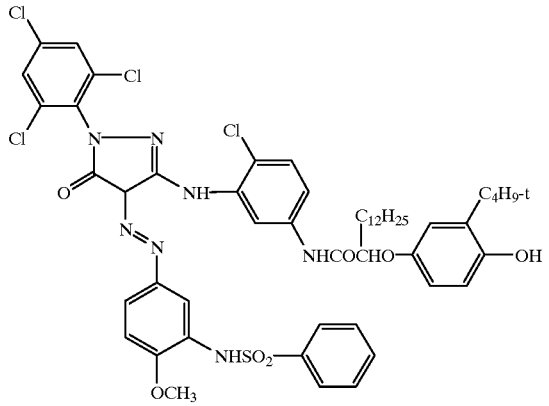

Compounds I-1, I-2, I-3 and C-2:

The coupler (0.27 g) was dissolved in 3.5 ml of water containing 2% w/w 2-phenoxyethanol. A portion of the resulting solution was diluted to a coupler concentration of $10^{-3}$ M and the diffusion coefficient of the self-assembled aggregates at 23° C. was measured by pulse gradient spin echo (PGSE) NMR spectroscopy. The hydrodynamic size of the aggregates was obtained from the diffusion coefficient based on the Stokes-Einstein equation.

| Coupler | Diffusion coefficient ($cm^2/s$) | Hydrodynamic size (Å) |
|---|---|---|
| I-1 | $5.1 \times 10^{-7}$ | 70 |
| I-2 | $4.5 \times 10^{-7}$ | 80 |
| I-3 | $4.4 \times 10^{-7}$ | 82 |
| C-2 | $4.7 \times 10^{-7}$ | 76 |

Compounds C-3 and C-4:

These compounds did not have adequate solubility in water containing 2% w/w alcohol. Dispersions were prepared by first dissolving the coupler (0.25 g) in 0.52 ml of n-propanol and then combining this with 0.35 ml of a 4% w/w aqueous solution of sodium hydroxide. Poly (vinylpyrrolidone) (0.25 g K-25 grade from BASF) and 0.24 g of sodium dodecyl sulfate were dissolved in 8.6 ml of water and this was added to the solution of the coupler in propanol and aqueous sodium hydroxide. The pH was then adjusted to 6.0 by the addition of a 15% w/w solution of acetic acid in water. The resulting suspension was washed with distilled water for 2 hours using SpectraPor™ dialysis membrane tubing.

Compounds C-1 and C-5:

These compounds also did not have adequate solubility in water containing 2% w/w alcohol. Dispersions were prepared by first dissolving the coupler (0.45 g) in ethyl acetate. This was then mixed with an aqueous solution containing 6.0 g of 12.5% w/w gelatin, 8.35 ml of distilled water and 0.2 ml of 10% w/w Alkanol XC. The mixture was passed three times through a colloid mill and the ethyl acetate was then removed by evaporation.

Coating and Evaluation

The above dispersions were combined with silver halide emulsion and additional gelatin and coated on a film support to give coupler, silver and gelatin laydowns of 344 $\mu mol/m^2$, 0.81 $g/m^2$ and 2.7 $g/m^2$ respectively. 35 mm strips from these coatings were exposed using a standard 21 step tablet and processed by the C41 process with a development time of 45 seconds. The status M green and blue densities were then recorded.

| | Density at minimum exposure (Dmin) | | Density at maximum exposure (Dmax) | | |
|---|---|---|---|---|---|
| Coupler | Blue | Green | Blue | Green | |
| I-1 | 0.47 | 0.12 | 0.36 | 0.77 | Invention |
| I-2 | 0.58 | 0.16 | 0.25 | 0.93 | Invention |
| I-3 | 0.52 | 0.23 | 0.20 | 0.93 | Invention |
| C-1 | 0.63 | 0.13 | 0.62 | 0.25 | Comparative |
| C-2 | 0.23 | 0.09 | 0.24 | 0.11 | Comparative |
| C-3 | 1.03 | 0.10 | 1.09 | 0.10 | Comparative |
| C-4 | 0.55 | 0.08 | 0.52 | 0.26 | Comparative |
| C-5 | 0.89 | 0.11 | 0.90 | 0.15 | Comparative |

It is clear that the use of couplers in accordance with the invention results in self-assembled aggregates of the coupler (in water containing at most 2% w/w alcohol) having adequate size and displaying good photographic activity (in terms of gain in status M green density and reduction in blue density as a function of exposure) in coatings that do not contain any high boiling (permanent) coupler solvents.

PHOTOGRAPHIC EXAMPLE 2

The invention can be better appreciated by reference to the following specific color negative film element embodiments. All coating coverages are reported in parenthesis in terms of $g/m^2$, except as otherwise indicated. Silver halide coating coverages are reported in terms of silver. The symbol "M %" indicates mol percent.

Glossary of Acronyms

| | |
|---|---|
| HBS-1 | Tritoluoyl phosphate |
| HBS-2 | Di-n-butyl phthalate |
| HBS-3 | N-n-Butyl acetanilide |
| HBS-4 | Tris(2-ethylhexyl) phosphate |
| HBS-5 | N,N-Diethyl lauramide |
| H-1 | Bis(vinylsulfonyl) methane |
| TAI | 4-Hydroxy-6-methyl-1,3,3a,7-tetraazaindene, sodium salt |

ST-1

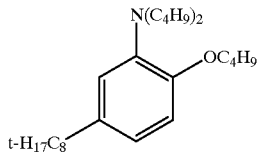

-continued
| Glossary of Acronyms |
| --- |
C1
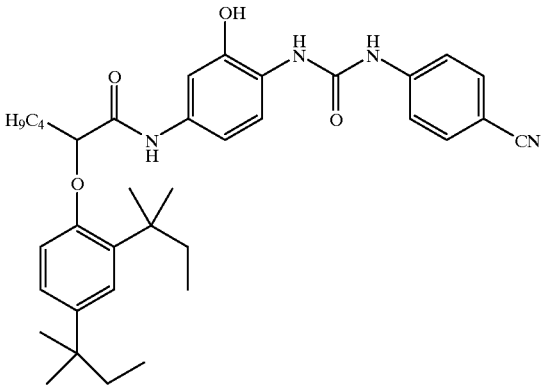
M1
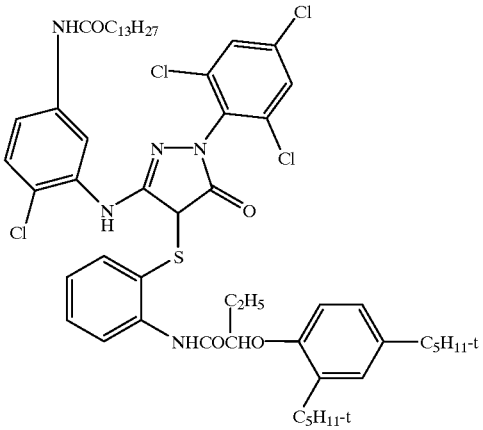
Y1
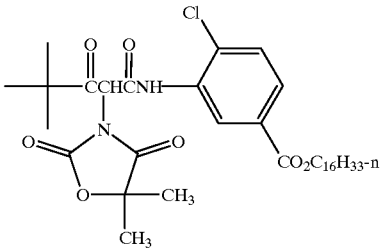

-continued
| Glossary of Acronyms |
|---|
| DIR-1 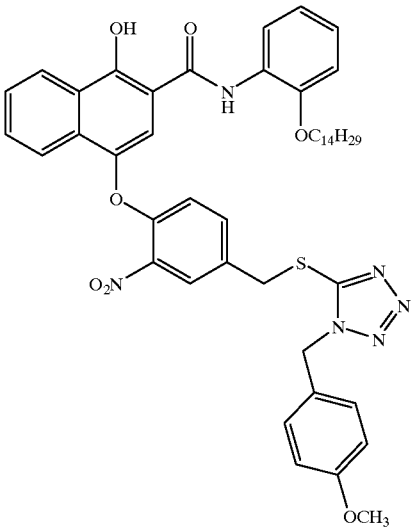 |
| DIR-2 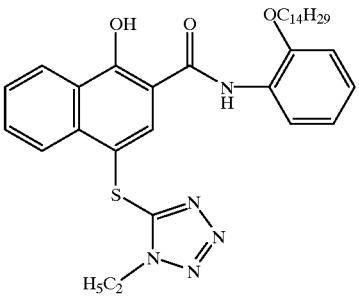 |
| DIR-3 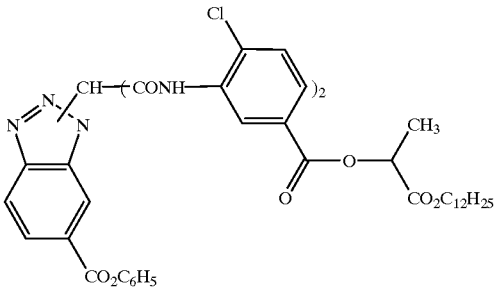 |
| DIR-4 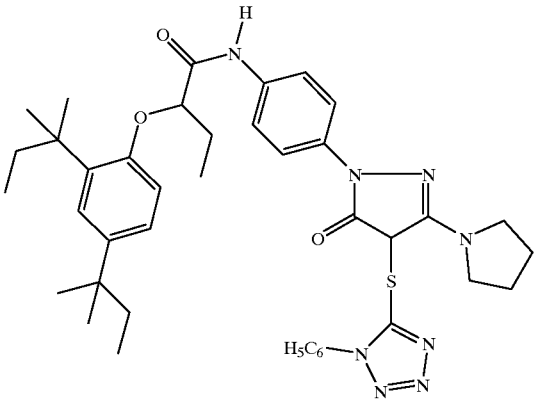 |

-continued
| Glossary of Acronyms |
|---|
| DIR-5 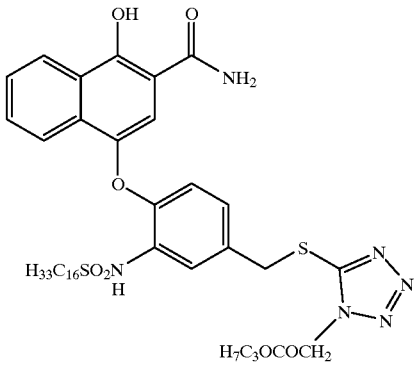 |
| DIR-6 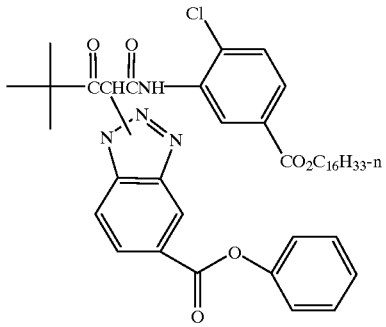 |
| CM-1 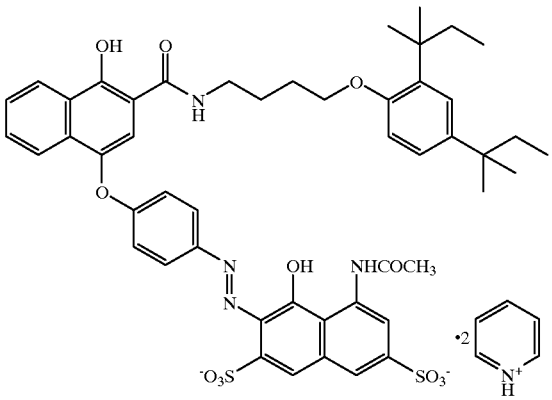 |
| MM-1 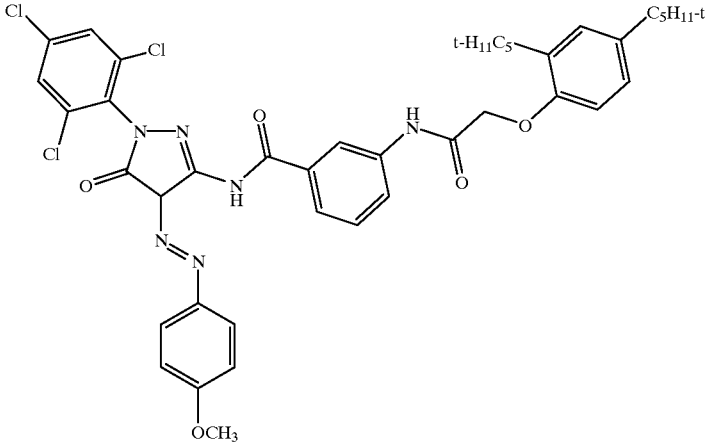 |

-continued
| Glossary of Acronyms |
|---|
MD-1
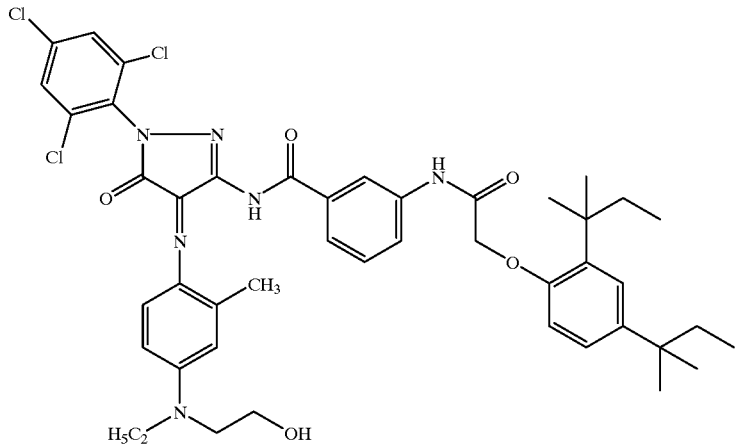
B-1
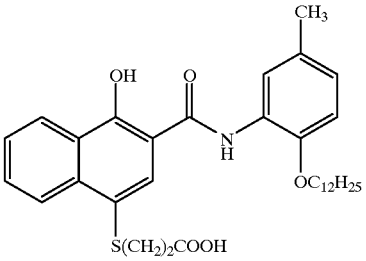
YD-1
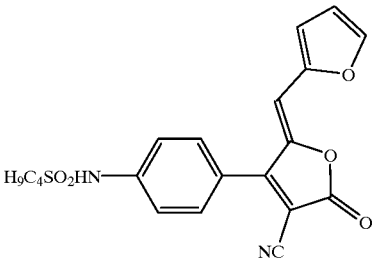
UV-1
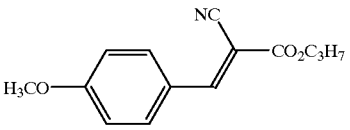
UV-2
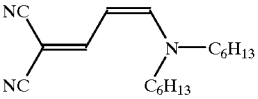
S-1
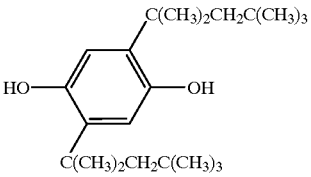

-continued

| Glossary of Acronyms | |
|---|---|
| S-2 | 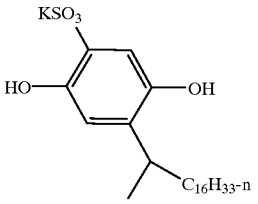 |

Dispersion and Solution Preparation

The comparative control yellow colored magenta masking coupler C-1 is water insoluble and a conventional milled photographic dispersion is prepared as follows: Masking coupler C-1 (4.5 g) is combined with two parts by weight of high boiling oil HBS-1 (9.0 g); the coupler and oil are dissolved in ethyl acetate. This oil phase solution is then mixed with an aqueous phase solution containing 72 grams of 12.5% w/w gelatin, 80 ml of distilled water and 2 ml of 10% w/w Alkanol XC surfactant. The mixture is passed three times through a colloid mill and the ethyl acetate is then removed by rotary evaporation. Distilled water is added back to form a dispersion comprised of 4% masking coupler, 8% permanent high boiling oil, and 8% gelatin. The dispersion is combined with other ingredients to form a liquid coating solution and produce Sample 201 as described below following extrusion coating.

An aqueous solution of yellow colored magenta masking coupler I-1 of the invention is prepared as follows: Masking coupler I-1 (1.0 g) is dissolved in 8.4 ml of a solution containing 2% w/w 2-phenoxyethanol by gentle heating, resulting in a concentration of 10.7% by weight of I-1. A liquid coating solution is prepared by combining this solution with 181 g of distilled water. A final concentration of 0.53% I-1 by weight results. The solution is combined with other ingredients during extrusion coating to produce Sample 202 as described below.

Sample 201 (Comparative Control)

This sample is prepared by applying the following layers in the sequence recited to a transparent film support of cellulose triacetate with conventional subbing layers, with the red recording layer unit coated nearest the support. The side of the support to be coated is prepared by the application of gelatin subbing.

Layer 1: AHU

| | |
|---|---|
| Black colloidal silver sol | (0.107) |
| UV-1 | (0.075) |
| UV-2 | (0.075) |
| Oxidized developer scavenger S-1 | (0.161) |
| Compensatory printing density cyan dye CD-1 | (0.034) |
| Compensatory printing density magenta dye MD-1 | (0.013) |
| Compensatory printing density yellow dye MM-1 | (0.095) |
| HBS-1 | (0.105) |
| HBS-2 | (0.399) |
| HBS-4 | (0.013) |
| Disodium salt of 3,5-disulfocatechol | (0.215) |
| Gelatin | (2.152) |

Layer 2: SRU

This layer is comprised of a blend of a lower and higher (lower and higher grain ECD) sensitivity, red-sensitized tabular silver iodobromide emulsions respectively containing 1.5 M % and 4.1 M % iodide, based on silver.

| | |
|---|---|
| AgIBr (0.55 μm ECD, 0.08 μm t) | (0.355) |
| AgIBr (0.66 μm ECD, 0.12 μm t) | (0.328) |
| Bleach accelerator coupler B-1 | (0.075) |
| DIR-1 | (0.015) |
| Cyan dye forming coupler C1 | (0.359) |
| HBS-2 | (0.359) |
| HBS-3 | (0.030) |
| HBS-5 | (0.098) |
| TAI | (0.011) |
| Gelatin | (1.668) |

Layer 3: MRU

This layer is comprised of a red-sensitized tabular silver iodobromide emulsion containing 4.1 M % iodide, based on silver.

| | |
|---|---|
| AgIBr (1.30 μm ECD, 0.12 μm t) | (1.162) |
| Bleach accelerator coupler B-1 | (0.005) |
| DIR-1 | (0.016) |
| Cyan dye forming magenta colored coupler CM-1 | (0.059) |
| Cyan dye forming coupler C1 | (0.207) |
| HBS-2 | (0.207) |
| HBS-3 | (0.032) |
| HBS-5 | (0.007) |
| TAI | (0.019) |
| Gelatin | (1.291) |

Layer 4: FRU

This layer is comprised of a red-sensitized tabular silver iodobromide emulsion containing 3.7 M % iodide, based on silver.

| | |
|---|---|
| AgIBr (2.61 μm ECD, 0.12 μm t) | (1.060) |
| Bleach accelerator coupler B-1 | (0.005) |
| DIR-2 | (0.048) |
| DIR-1 | (0.027) |
| Cyan dye forming magenta colored coupler CM-1 | (0.022) |
| Cyan dye forming coupler C1 | (0.312) |
| HBS-1 | (0.194) |
| HBS-2 | (0.274) |
| HBS-3 | (0.054) |
| HBS-5 | (0.007) |
| TAI | (0.010) |
| Gelatin | (1.291) |

Layer 5: Interlayer

| | |
|---|---|
| Oxidized developer scavenger S-1 | (0.086) |
| HBS-4 | (0.129) |
| Gelatin | (0.538) |

Layer 6: SGU

This layer is comprised of a blend of a lower and higher (lower and higher grain ECD) sensitivity, green-sensitized tabular silver iodobromide emulsions respectively containing 2.6 M % and 4.1 M % iodide, based on silver.

| | |
|---|---|
| AgIBr (0.81 μm ECD, 0.12 μm t) | (0.251) |
| AgIBr (0.92 μm ECD, 0.12 μm t) | (0.110) |
| Comparison Magenta dye forming yellow colored coupler C-1 | (0.054) |
| Magenta dye forming coupler M1 | (0.339) |
| Stabilizer ST-1 | (0.034) |
| HBS-1 | (0.413) |
| TAI | (0.006) |
| Gelatin | (1.721) |

Layer 7: MGU

This layer is comprised of a blend of a lower and higher (lower and higher grain ECD) sensitivity, green-sensitized tabular silver iodobromide emulsions each containing 4.1 M % iodide, based on silver.

| | |
|---|---|
| AgIBr (0.92 μm ECD, 0.12 μm t) | (0.113) |
| AgIBr (1.22 μm ECD, 0.11 μm t) | (1.334) |
| DIR-3 | (0.032) |
| Comparison Magenta dye forming yellow colored coupler C-1 | (0.118) |
| Magenta dye forming coupler M1 | (0.087) |
| Oxidized developer scavenger S-2 | (0.018) |
| HBS-1 | (0.315) |
| HBS-2 | (0.032) |
| Stabilizer ST-1 | (0.009) |
| TAI | (0.023) |
| Gelatin | (1.668) |

Layer 8: FGU

This layer is comprised of a green-sensitized tabular silver iodobromide emulsion containing 4.1 M % iodide, based on silver.

| | |
|---|---|
| AgIBr (2.49 μm ECD, 0.14 μm t) | (0.909) |
| DIR-4 | (0.003) |
| DIR-5 | (0.032) |
| Comparison Magenta dye forming yellow colored coupler C-1 | (0.054) |
| Magenta dye forming coupler M1 | (0.113) |
| HBS-1 | (0.216) |
| HBS-2 | (0.065) |
| Stabilizer ST-1 | (0.011) |
| TAI | (0.011) |
| Gelatin | (1.405) |

Layer 9: Yellow Filter Layer

| | |
|---|---|
| Yellow filter dye YD-1 | (0.054) |
| Oxidized developer scavenger S-1 | (0.086) |
| HBS-4 | (0.129) |
| Gelatin | (0.646) |

Layer 10: SBU

This layer is comprised of a blend of a lower, medium and higher (lower, medium and higher grain ECD) sensitivity, blue-sensitized tabular silver iodobromide emulsions respectively containing 1.5 M %, 1.5 M % and 4.1 M % iodide, based on silver.

| | |
|---|---|
| AgIBr (0.55 μm ECD, 0.08 μm t) | (0.156) |
| AgIBr (0.77 μm ECD, 0.14 μm t) | (0.269) |
| AgIBr (1.25 μm ECD, 0.14 μm t) | (0.430) |
| DIR-1 | (0.027) |
| DIR-6 | (0.054) |
| Yellow dye forming coupler Y1 | (1.022) |
| Bleach accelerator coupler B-1 | (0.011) |
| HBS-1 | (0.538) |
| HBS-3 | (0.054) |

-continued

| | |
|---|---|
| HBS-5 | (0.014) |
| TAI | (0.014) |
| Gelatin | (2.119) |

Layer 11: FBU

This layer is comprised of a blue-sensitized silver iodobromide emulsion containing 9.0 M % iodide, based on silver.

| | |
|---|---|
| AgIBr (1.04 μm ECD) | (0.699) |
| Unsensitized silver bromide Lippmann emulsion | (0.054) |
| Yellow dye forming coupler Y1 | (0.473) |
| DIR-6 | (0.086) |
| Bleach accelerator coupler B-1 | (0.005) |
| HBS-1 | (0.280) |
| HBS-5 | (0.004) |
| TAI | (0.012) |
| Gelatin | (1.183) |

Layer 12: Ultraviolet Filter Layer

| | |
|---|---|
| Dye UV-1 | (0.108) |
| Dye UV-2 | (0.108) |
| Unsensitized silver bromide Lippmann emulsion | (0.215) |
| HBS-1 | (0.151) |
| Gelatin | (0.699) |

Layer 13: Protective Overcoat Layer

| | |
|---|---|
| Polymethylmethacrylate matte beads | (0.005) |
| Soluble polymethylmethacrylate matte beads | (0.108) |
| Silicone lubricant | (0.039) |
| Gelatin | (0.882) |

This film is hardened at the time of coating with 1.80% by weight of total gelatin of hardener H-1. Surfactants, coating aids, soluble absorber dyes, antifoggants, stabilizers, antistatic agents, biostats, biocides, and other addenda chemicals were added to the various layers of this sample, as is commonly practiced in the art.

Sample 202 (Invention)

Except as indicated below, this sample is prepared as described above in connection with Sample 201.

Layer 6: SGU Changes

| | |
|---|---|
| Comparison Magenta dye forming yellow colored coupler C-1 | (0.000) |
| Invention Magenta dye forming yellow colored coupler I-1 | (0.070) |
| HBS-1 | (0.305) |

Layer 7: MGU Changes

| | |
|---|---|
| Comparison Magenta dye forming yellow colored coupler C-1 | (0.000) |
| Invention Magenta dye forming yellow colored coupler I-1 | (0.154) |
| HBS-1 | (0.079) |

Layer 8: FGU Changes

| | |
|---|---|
| Comparison Magenta dye forming yellow colored coupler C-1 | (0.000) |
| Invention Magenta dye forming yellow colored coupler I-1 | (0.070) |
| HBS-1 | (0.108) |

It will be appreciated that the incorporation of 0.23 g/m$^2$ of yellow colored magenta masking coupler C-1 of the art into the green sensitive unit of sample 201 has the undesirable effect of carrying in an additional 0.45 g/m$^2$ of permanent coupler solvent HBS-1 relative to sample 202. This additional material is required for coupler solubilization in the dispersion making process and for increasing coupling activity. The permanent coupler solvent increases Sample 201 layer thickness appreciably (ca. 0.4 micrometers) which reduces red unit developability and increases the spread of incident exposing light, degrading image sharpness. The HBS-1 constitutes a non-cross-linking, low glass-transition temperature filler that may require the unit to a contain higher load of gelatin vehicle to maintain the physical integrity of the photographic recording material than otherwise necessary. High loads of high boiling solvent are known to cause poor edge fracture in film slitting and perforating operations, leading to dirt and premature knife wear. It will be appreciated that the substitution of the yellow colored magenta masking coupler I-1 of the invention in Sample 202 for C-1 in Sample 201 results in a quite significant net material load reduction in Sample 202, as well as a reduction in HBS-1, consistent with the goals of the invention.

The primary desirable effect of an incorporated color masking coupler is to produce imagewise interlayer interimage effects by a causing color recording unit that result in the reduction of integral density formed by a receiving color recording unit, relative to the absence of the effects. Samples of films 201–202 are individually exposed for 1/50 of a second to white light from a tungsten bulb source that is filtered by a Daylight Va filter to 5500K, through a 550-nm interference filter and through a graduated 0–4.0 density step tablet. This is an imagewise green light separation exposure. The samples are additionally exposed by the same white light source corrected to 5500K color temperature in a series of six non-imagewise flash exposures by filtering the incident white light through a Kodak WRATTEN™ Gelatin Filter No. 98 and neutral density filters differing by 0.3 density difference increments. These are non-imagewise blue flash separation exposures. The exposed films are processed through the Kodak Flexicolor™ C-41 process, as described by *The British Journal of Photography Annual* of 1988, pp. 196–198. Another description of the use of the C-41 process is provided by *Using Kodak Flexicolor™ Chemicals,* Kodak Publication No. Z-131, Eastman Kodak Company, Rochester, N.Y. The processed film samples are subjected to Status M integral densitometry.

A representative example of the operation of interlayer interimage effects is observed in the comparative control Sample 201 data. An integral blue density of 1.9 is observed for an intermediate level blue flash exposure in the green unexposed region (minimum green density region), and an integral blue density of 1.6 is observed in the green overexposure region for the same blue flash exposure. The imagewise green exposure reduction of integral blue density by 0.3 density, despite the production of unwanted blue density from the imagewise formation of ca. 2.6 Status M green density, primarily reflects the coupling of yellowed colored magenta masking coupler C-1 and the release and wash-out, or destruction, of the yellow masking dye coupling-off group. When the same blue flash exposure density curve is examined for inventive Sample 202 comprised of masking coupler I-1, a comparable imagewise green exposure reduction in integral blue density is achieved, despite the absence of significant quantities of high boiling solvent in the green unit of Sample 202 that was included with Sample 201 to obtain dispersion solubility and coupling activity with comparative control masking coupler C-1. A comparable amount of green density is also formed in an imagewise fashion for Sample 202.

The invention has been described in detail with particular reference to preferred embodiments thereof, but it will be understood that variations and modifications can be effected within the spirit and scope of the invention.

We claim:

1. A multilayer silver halide color photographic element comprising a support bearing a light-sensitive silver halide emulsion layer and a non-diffusible yellow-colored magenta dye-forming masking coupler of the following formula

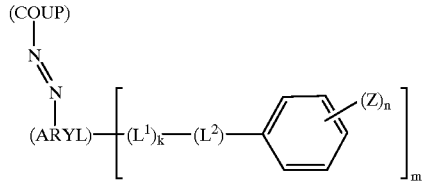

wherein

COUP is a magenta dye-forming coupler having the azo group attached to its coupling position;

ARYL represents an aromatic group;

m represents an integer of from 1 to 4;

each $L^1$ represents a divalent linking group;

each k is either 0 or 1;

each $L^2$ represents —$NHSO_2$—, NHCO—, —$SO_2NH$—, or —CONH—;

each Z represents —$SO_3M$ or —$PO_3M$, where M represents H or a counter ion; and n represents an integer of from 1 to 5;

with the provisos that when at least one $L^1$ or $L^2$ group comprises an —$NHSO_2$— or —$SO_2NH$— group then the total number of Z group substituents on the coupler is at least 2, and when no $L^1$ or $L^2$ group comprises an —$NHSO_2$— or —$SO_2NH$— group then the total number of Z group substituents on the coupler is at least 3, and if k is 0 for a substituent on the ARYL group then the $L^2$ group for that substituent is either —$NHSO_2$— or —NHCO—.

2. An element according to claim 1, wherein ARYL comprises a phenyl group, a naphthyl group or a heteroaryl group.

3. An element according to claim 1, wherein ARYL comprises a phenyl group.

4. An element according to claim 1, wherein k is 1 and $L^1$ represents —$O(CH_2)_y$—, —$NHCO(CH_2)_y$, or —$NRCO(CH_2)_y$—, where R represents an alkyl or aryl group and y represents an integer from 1 to 4.

5. An element according to claim 1, wherein $L^2$ represents —$NHSO_2$—.

6. An element according to claim 1, wherein COUP is a 5-pyrazolone dye-forming coupler.

7. An element according to claim 1, wherein COUP is a 5-pyrazolone coupler having an anilino group in the 3-position.

8. An element according to claim 1, wherein COUP is represented by the structure:

(M-6)

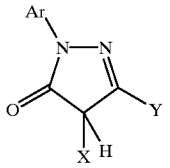

where

Ar is selected from the group consisting of unsubstituted aryl groups, substituted aryl groups and substituted pyridyl groups, the substituents being selected from the group consisting of halogen atoms and cyano, alkylsulfonyl, arylsulfonyl, sulfamoyl, sulfonamido, carbamoyl, carbonamido, alkoxy, acyloxy, aryloxy, alkoxycarbonyl, aryloxycarbonyl, ureido, nitro, alkyl, and trifluoromethyl groups, or Ar is an aryl group substituted with a group which forms a link to a polymeric chain;

Y is an anilino group substituted with one or more substituents selected from the group consisting of halogen atoms, and alkyl, aryl, alkoxy, aryloxy, carbonamido, carbamoyl, sulfonamido, sulfamoyl, alkylsulfinyl, arylsulfinyl, alkylsulfonyl, arylsulfonyl, alkoxycarbonyl, aryloxycarbonyl, acyl, acyloxy, ureido, imido, carbamate, heterocyclic, cyano, trifluoromethyl, alkylthio, nitro, carboxyl and hydroxyl groups, and groups which form a link to a polymeric chain, and wherein Y contains at least 6 carbon atoms; and X represents the coupling-off position.

9. An element according to claim 1, wherein COUP comprises a ballast group of such size and configuration that, in combination with the remainder of the molecule, it provides the coupler with sufficient bulk to be substantially non-diffusible from the layer in which it is coated in the element.

10. An element according to claim 1, wherein the masking coupler is present in the element at a coverage of less than 0.4 mmol/$m^2$.

11. An element according to claim 1, wherein the masking coupler is present in the element at a coverage of from 0.1 mmol/$m^2$ to 0.3 mmol/$m^2$.

12. An element according to claim 1, wherein the colored coupler is of the formula:

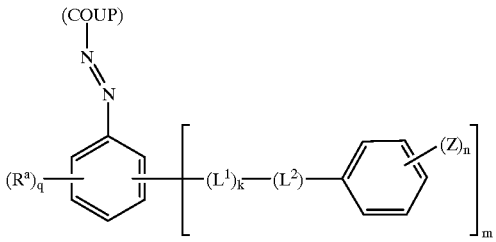

wherein:

q is an integer of from 1 to 4, and each $R^a$ independently represents a substituent group with a Hammett sigma-para value of less than 0.05, or two $R^a$ groups together complete a ring of from 5–7 atoms.

13. An element according to claim 12, wherein at least one $R^a$ group represents OR, R, $NHSO_2R$, NHCOR, or $NR_2$, where R represents an alkyl or aryl group.

14. An element according to claim 12, wherein k is 1 and $L^1$ represents —$O(CH_2)_y$—, —$NHCO(CH_2)_y$, or —$NRCO(CH_2)_y$—, where R represents an alkyl or aryl group and y represents an integer from 1 to 4.

15. An element according to claim 12, wherein $L^2$ represents —$NHSO_2$—.

16. An element according to claim 12, wherein COUP is a 5-pyrazolone dye-forming coupler.

17. An element according to claim 12, wherein COUP is a 5-pyrazolone coupler having an anilino group in the 3-position.

18. An element according to claim 12, wherein COUP is represented by the structure:

(M-6)

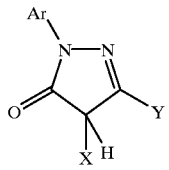

where:

Ar is selected from the group consisting of unsubstituted aryl groups, substituted aryl groups and substituted pyridyl groups, the substituents being selected from the group consisting of halogen atoms and cyano, alkylsulfonyl, arylsulfonyl, sulfamoyl, sulfonamido, carbamoyl, carbonamido, alkoxy, acyloxy, aryloxy, alkoxycarbonyl, aryloxycarbonyl, ureido, nitro, alkyl, and trifluoromethyl groups, or Ar is an aryl group substituted with a group which forms a link to a polymeric chain;

Y is an anilino group substituted with one or more substituents selected from the group consisting of halogen atoms, and alkyl, aryl, alkoxy, aryloxy, carbonamido, carbamoyl, sulfonamido, sulfamoyl, alkylsulfinyl, arylsulfinyl, alkylsulfonyl, arylsulfonyl, alkoxycarbonyl, aryloxycarbonyl, acyl, acyloxy, ureido, imido, carbamate, heterocyclic, cyano, trifluoromethyl, alkylthio, nitro, carboxyl and hydroxyl groups, and groups which form a link to a polymeric chain, and wherein Y contains at least 6 carbon atoms; and X represents the coupling-off position.

19. An element according to claim 12, wherein COUP comprises a ballast group of such size and configuration that, in combination with the remainder of the molecule, it provides the coupler with sufficient bulk to be substantially non-diffusible from the layer in which it is coated in the element.

20. An element according to claim 12, wherein the masking coupler is present in the element at a coverage of less than 0.4 mmol/$m^2$.

21. An element according to claim 12, wherein the masking coupler is present in the element at a coverage of from 0.1 mmol/$m^2$ to 0.3 mmol/$m^2$.

* * * * *